US008246480B2

(12) United States Patent
Parks et al.

(10) Patent No.: US 8,246,480 B2
(45) Date of Patent: Aug. 21, 2012

(54) GOLF BALL HOLDING STRUCTURE

(75) Inventors: Willam Parks, Orlando, FL (US); Harpreet Suri, Orlando, FL (US)

(73) Assignee: Swing Sensei, LLC, Orlando, FL (US)

( * ) Notice: Subject to any disclaimer, the term of this patent is extended or adjusted under 35 U.S.C. 154(b) by 50 days.

(21) Appl. No.: 12/847,210

(22) Filed: Jul. 30, 2010

(65) Prior Publication Data

US 2010/0298061 A1 Nov. 25, 2010

Related U.S. Application Data

(63) Continuation-in-part of application No. 12/578,994, filed on Oct. 14, 2009, now abandoned.

(60) Provisional application No. 61/166,457, filed on Apr. 3, 2009.

(51) Int. Cl.
*A63B 69/36* (2006.01)
*A63B 53/00* (2006.01)

(52) U.S. Cl. ..... 473/226; 473/235; 473/236; 473/244; 473/282; 473/286

(58) Field of Classification Search ..... 273/317; 473/282, 505, 513, 219–256, 286; 119/702, 119/707; 294/19.1, 19.2
See application file for complete search history.

(56) References Cited

U.S. PATENT DOCUMENTS

| | | | | | |
|---|---|---|---|---|---|
| 1,739,467 | A | * | 12/1929 | Klutho | 273/317.2 |
| 1,759,622 | A | | 5/1930 | Kenney | |
| 1,994,207 | A | | 3/1935 | Ahles | |
| 2,057,821 | A | | 10/1936 | Costello | |
| 2,157,415 | A | * | 5/1939 | Jones | 473/235 |
| 2,465,124 | A | * | 3/1949 | Sante | 473/235 |
| 3,259,387 | A | * | 7/1966 | Beigay | 473/174 |
| 3,428,036 | A | * | 2/1969 | Parker | 124/5 |
| 3,589,349 | A | * | 6/1971 | Parker | 124/5 |
| 4,085,936 | A | | 4/1978 | Patterson | |
| 4,139,198 | A | * | 2/1979 | Kanavas | 473/236 |
| 4,317,567 | A | | 3/1982 | Blake | |
| 4,892,317 | A | | 1/1990 | Corder | |
| 5,150,901 | A | | 9/1992 | Stawicki | |
| 5,522,594 | A | * | 6/1996 | Taylor et al. | 473/131 |
| 7,104,897 | B2 | | 9/2006 | Park | |
| 7,118,489 | B1 | | 10/2006 | Hubley | |
| 7,520,818 | B2 | | 4/2009 | Winchester | |
| 7,686,702 | B2 | * | 3/2010 | Hubley | 473/226 |
| 7,785,211 | B2 | | 8/2010 | Hackenberg | |
| 2004/0063511 | A1 | | 4/2004 | Middleton | |
| 2008/0153616 | A1 | | 6/2008 | Hubley | |

* cited by examiner

*Primary Examiner* — Sebastiano Passaniti
(74) *Attorney, Agent, or Firm* — Kenneth C. Spafford

(57) ABSTRACT

An apparatus which uses a club having a head portion and a shaft. Integrated with the head portion is a shaped recess with a golf ball holder. The golf ball holder is capable of gripping and holding a golf ball with a predetermined force requirement for release, which requires the user to execute a proper golf swing to release the ball. The predetermined force requirement may be adjustable. The user also may vary the angle of the club face on various planes relative to the shaft, thereby changing the swing required to release the ball.

6 Claims, 20 Drawing Sheets

399

GOLF BALL HOLDING STRUCTURE

CROSS-REFERENCE TO RELATED APPLICATIONS

This application is a continuation-in-part of application Ser. No. 12/578,994, filed Oct. 14, 2009 now abandoned; and application Ser. No. 12/578,994 claims the benefit of provisional Application No. 61/166,457, filed on Apr. 3, 2009.

This application incorporates by reference all of the following applications, including specification, claims, and figures: U.S. application Ser. No. 12/578,994, filed Oct. 14, 2009 and U.S. provisional Application No. 61/166,457, filed on Apr. 3, 2009.

FIELD OF THE INVENTION

This disclosure is directed to a device or an assembly that is a golf ball holder that can be attached, assembled, or manufactured as part or a portion of a golf club.

The device or assembly holds a golf ball in place at least partially inside the device or assembly with a predetermined force requirement. This predetermined force setting, which prevents an unwanted release of a ball, will allow a desired release of the ball when the assembly is swung in a manner that overcomes the predetermined force level requirement created by the holder's mechanism(s) so to allow dynamic release of a secured ball from the holder during a swing of the assembly.

The golf ball holder can include at least one mechanism that allows an adjustment of an opening size of the holder that will alter and fix the predetermined force setting against a portion or portions of a ball's surface.

The ball used in conjunction with the device can have a dimpled surface, a surface that is not smooth, any type of surface consistency and/or surface texture (a raised surface for example), a surface having indented features, or any other type of surface imaginable, consistent or not. The device is operable to utilize at least a portion of a ball's surface or one ball surface feature to aid in developing a secure hold upon the ball while the both the ball and the assembly are in motion together. While the device assembly with a ball is in motion, a predetermined force level is either met or not met. The force level setting in combination with the motion of the holder assembly will result in either a release or non-release of the golf ball held within the adjustable holder during a swing of the assembly.

BACKGROUND OF THE INVENTION

The sport of golf remains a highly popular worldwide source of exercise and recreation for persons of all ages and skill levels. Regardless of skill level or experience, users of all experience levels—from professional, to amateur, to novice—constantly work in improving their golf swings. Golf instruction represents a significant industry in the United States (as well as throughout the world).

Accordingly, there is a need for a device that can aid in helping a person execute a proper golf swing. This device can either be made, assembled or manufactured as part of a club. Alternatively, it can be made as a whole unit or club unit, or made as a sub-unit of a golf club that when attached or assembled into a club is operable to perform a swing in a manner that is consistent with the operational swing of a standard club.

SUMMARY OF THE INVENTION

A new device allows a user to develop a dynamic range swinging skill set rather than the static skill level of the prior art. The new device accomplishes the ability to develop a dynamic range swinging skill set with a force level utilized on a golf ball that is seated within a holder. The holder, in turn, acts upon the ball and effects either a release of the golf ball or not, during a swing operation.

An embodiment contemplates holding elements positioned in the holder as to allow the golf ball to exit the holder with an optimal velocity vector when the club is swung properly. Lines and grooves on the striking surface of ordinary club heads are substantially horizontal to the ground and not parallel with the shaft. In contrast, this embodiment contemplates a holder and holding elements that are substantially parallel with the shaft.

In one or more embodiments, the force requirement for releasing the ball can be adjusted and fixed before swinging. The device is offered to improve a user's swing by focusing on the proper techniques that can include a beginning point of a back-swing thru the point of a down swing and follow-thru of a motion of a swing utilizing a club having a shaft and a head portion (which has a club head face). At the head of the club is a shaped recess. This shaped recess is calibrated to be a sufficient size and dimension to hold and maintain a projectile throughout the back-swing and down-swing to release the projectile at a predictable point within or during a club swing motion path when swung.

The inventors also contemplate a holder assembly that allows for a predetermined adjustment of the holder diameter. This adjustable holder can be workable by a separate or integral mechanism or hand-bendable structure to act as a calibrated holder that is operable to be opened or contracted to a diameter of the semi circular recess of holder. An alternative system includes a series of cable strings to alter the outer diameter of the distal end of the holder. By making holder's diameter smaller, the user ensures greater support of the holder when launching the ball during the training swing. Decreasing holder's diameter requires the user to be more advanced and precise in his or her training swing. As yet another alternative embodiment, the head portion and holder (capable of being calibrated) are one single integral member placed at a distal end of the shaft of a club or a golf club.

An embodiment includes a holder whose contact points with the projectile can be rotated on the plane of the face of the club head. As a result, the force and acceleration vectors required to release the projectile from the holder can be subtly altered as the user wishes to fine-tune his or her swing.

Embodiments includes a holder portion or holder assembly that may be rotated and fixed at various planes relative to the hosel, thereby changing the force vector and acceleration requirements for releasing the projectile, as well as the projectile's trajectory when released.

An embodiment can include a noisemaker in the holder portion or holder assembly that is ordinarily stoppered by a projectile held in the recess. When the club is swung and the projectile is released, air flows through the noisemaker as the club is in motion to alert the user that the projectile has exited the recess of the assembly.

A holder is contemplated in one embodiment as having both a curved upper portion and a curved lower portion that both form a shaped recess. This shaped recess is calibrated to be a sufficient size and dimension to hold and maintain a standard size ball throughout the back-swing and down-swing to release the ball on at a predictable point within or during a club swing motion path during a properly executed swing.

Single noun words and their noun plural word form, such as, but not limited to, cradle, holder, clip, fastener, mechanism, tensioning structure, cable, structure, projectile holder, support recess, ball recess, recess, fastening structure, cradle, and forced holder, can be interchangeable with each other and can mean a structure that is operable for securing limited movement of a ball during motion or non-motion of the structure.

The word "mechanism" can have single or multiple meanings, functions or utilizations and can simply mean a single structure, a two structure assembly, or a multiple structure amalgamation. A mechanism may include a single structure for a setting or a creating of a predetermined position of another structure or a plurality of structures that when assembled together allow for an adjustable holding of a golf ball by the amalgamation of assembled parts. Such a mechanism or holder may be operable for a predetermined position that becomes a force setting for a ball release determinant.

The words club, shaft unit, club or a golf club, bat, swinging unit, or ball club can refer to or mean a single integral structure or to an assembly of a plurality of parts that form a whole or a part of a final club unit that is or are operable singularly or together as a device that propels a projectile when swung or allows for a ball secured in a restricted manner from moving for a portion of a swing movement. Such an assembly can be operable to have a structure that creates a predetermined position that is operable for holding and releasing a ball in a predetermined manner. The assembly is part of a larger unit and is operable for creating a predetermined force setting or release setting of a ball that will be determined by movement of the club as it is moved or swung by a machine or person.

DETAILED DESCRIPTION OF THE INVENTION

Preferred embodiments and others will now be described more fully hereinafter with reference to the accompanying drawings, in which preferred embodiments and others are shown. Preferred embodiments may, however, be embodied in many different forms and should not be construed as limited to the embodiments set forth herein. Rather, these embodiments are provided so that this disclosure will be thorough and complete, and will fully convey the scope to those skilled in the art. Like numbers refer to like elements throughout.

The disclosure is directed toward an apparatus 100, having an assembly 700 or 800 for example, for improving a user's golf game by focusing on the user's swing.

Accordingly, an apparatus 100, having an assembly 700 or 800 for example, allows for a release of a projectile 270 based upon a calibrated amount of force that is developed when the assembly is in motion. For example, a force developed when the user performs a properly executed swing such that the mechanism in combination with a projectile holder has been adjusted to a predetermined calibration that allows the projectile 270 will exit an assembly 700 or 800 for example, on a predictable flight path when the force level setting created by the prior manipulation of the mechanism in combination with a projectile holder has been achieved or even surpassed.

Put another way, the apparatus assembly allows for a desired trajectory of the ball to be achieved when the ball leaves the apparatus 100 having an assembly 700 or 800 for example, or apparatus 100, 700 or 800 for example. By engaging in a correct swing, the apparatus 100, 700 or 800 for example, and projectile 270 effectively act as one object, with an initial "start-up" acceleration applied initially in the down swing.

Figure 2A:
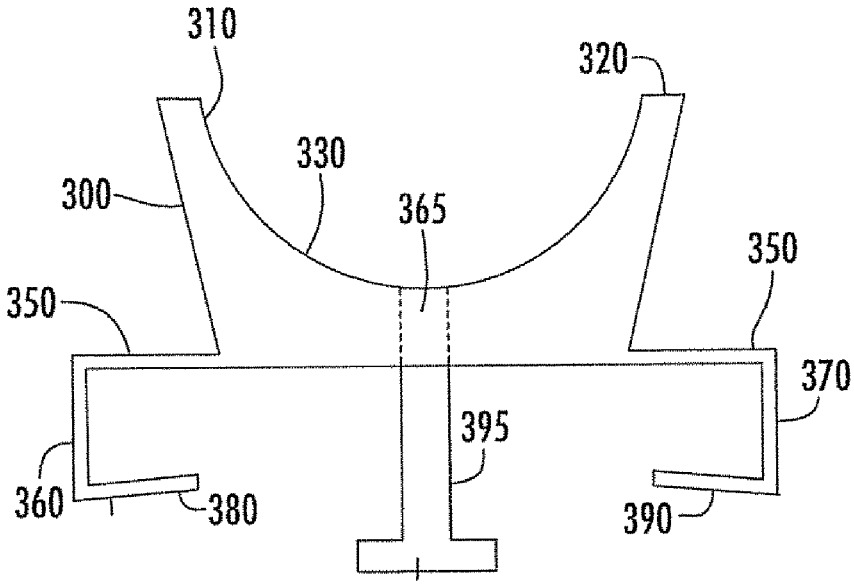
FIG. 2A is a side view of a present club.
Figure 2B:
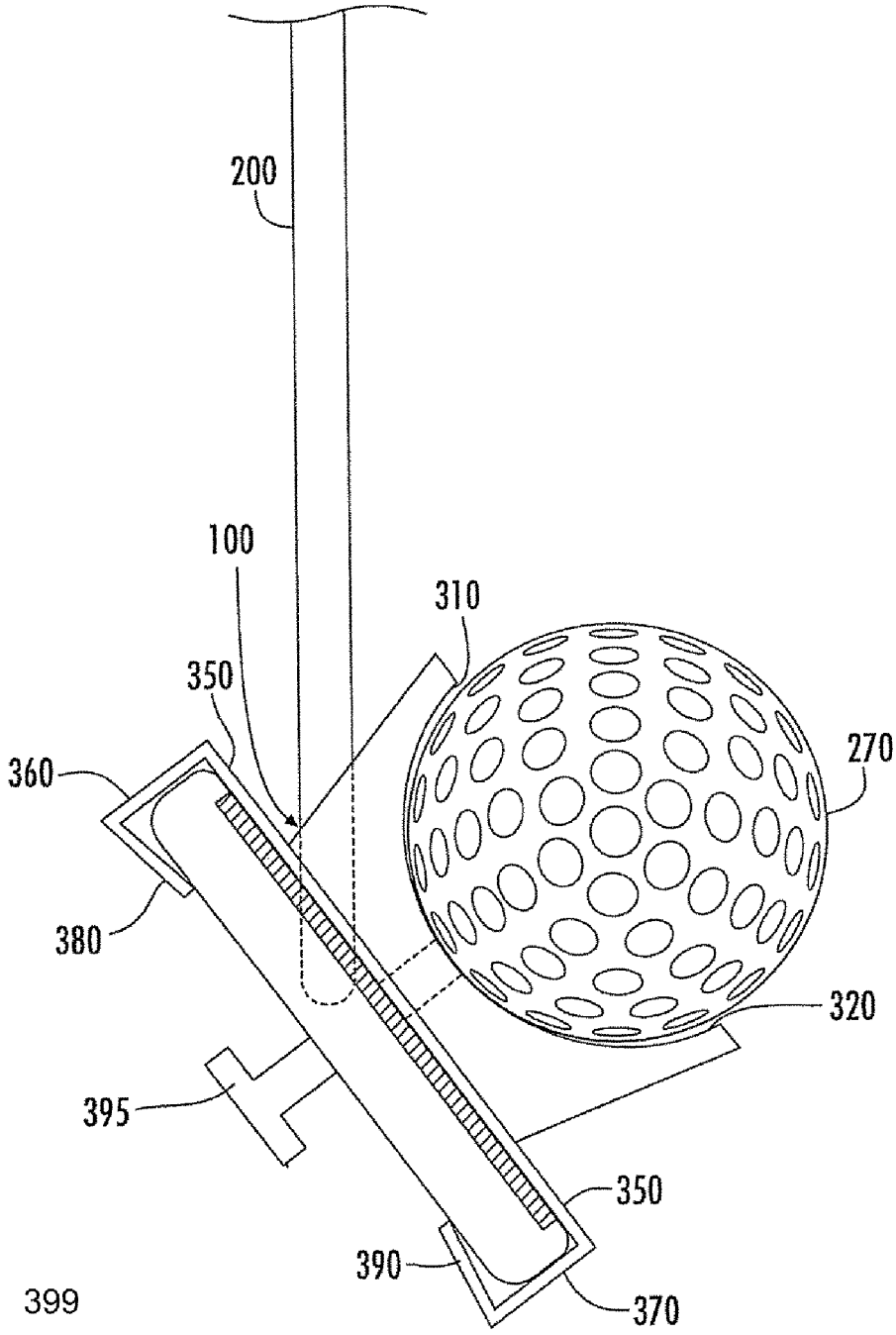
FIG. 2B is a side view of a present holder attached to a club shown in FIG. 2A.

As shown in FIG. 2B, the apparatus 100 for example, includes a club head or head portion 240, holder 300 and an assembly 399. The inventor contemplates an adjustable holder 500 in which various attributes of the holder 300 can include a feature that allows setting of a ball release before the club is moved. Such a mechanism can allow for a predetermined ball release setting to affect a force-applied release or a sensor activated release of a ball from the device.

Figure 1:
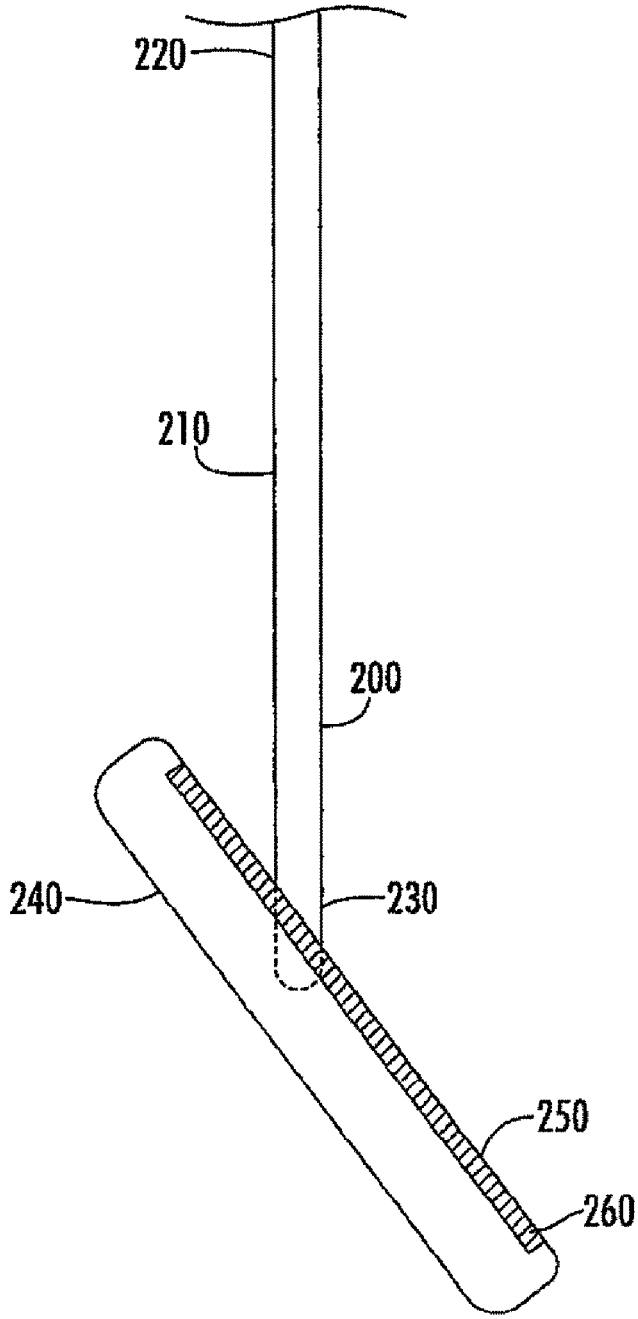
FIG. 1 (PRIOR ART)
FIG. 1 is a side view of a prior art golf club having a shaft and a head portion.
Figure 3A:
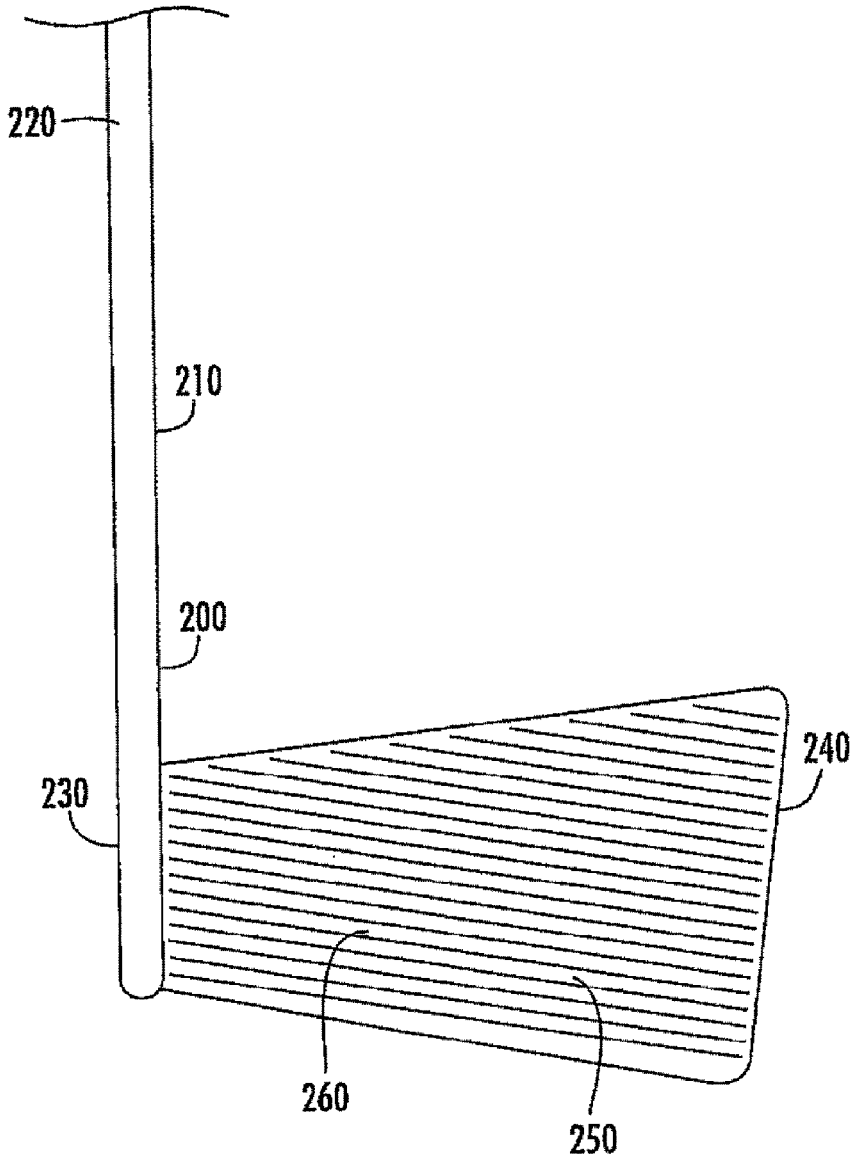
FIG. 3A (PRIOR ART)
FIG. 3A is a front view of a golf club having a shaft and a head portion.
Figure 3B:
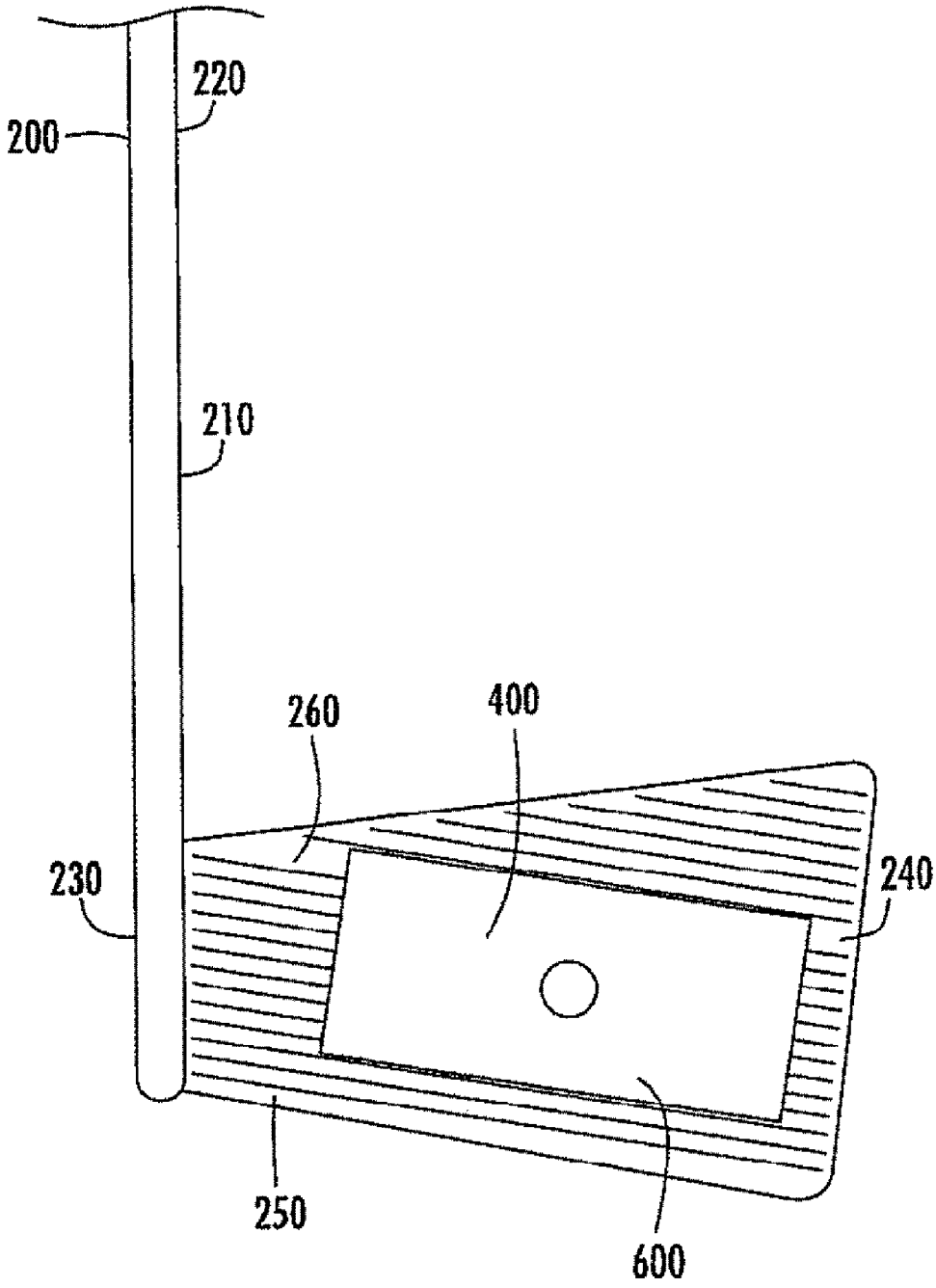
FIG. 3B is a front view of the club or a golf club shown in FIG. 3A.
Figure 3C:
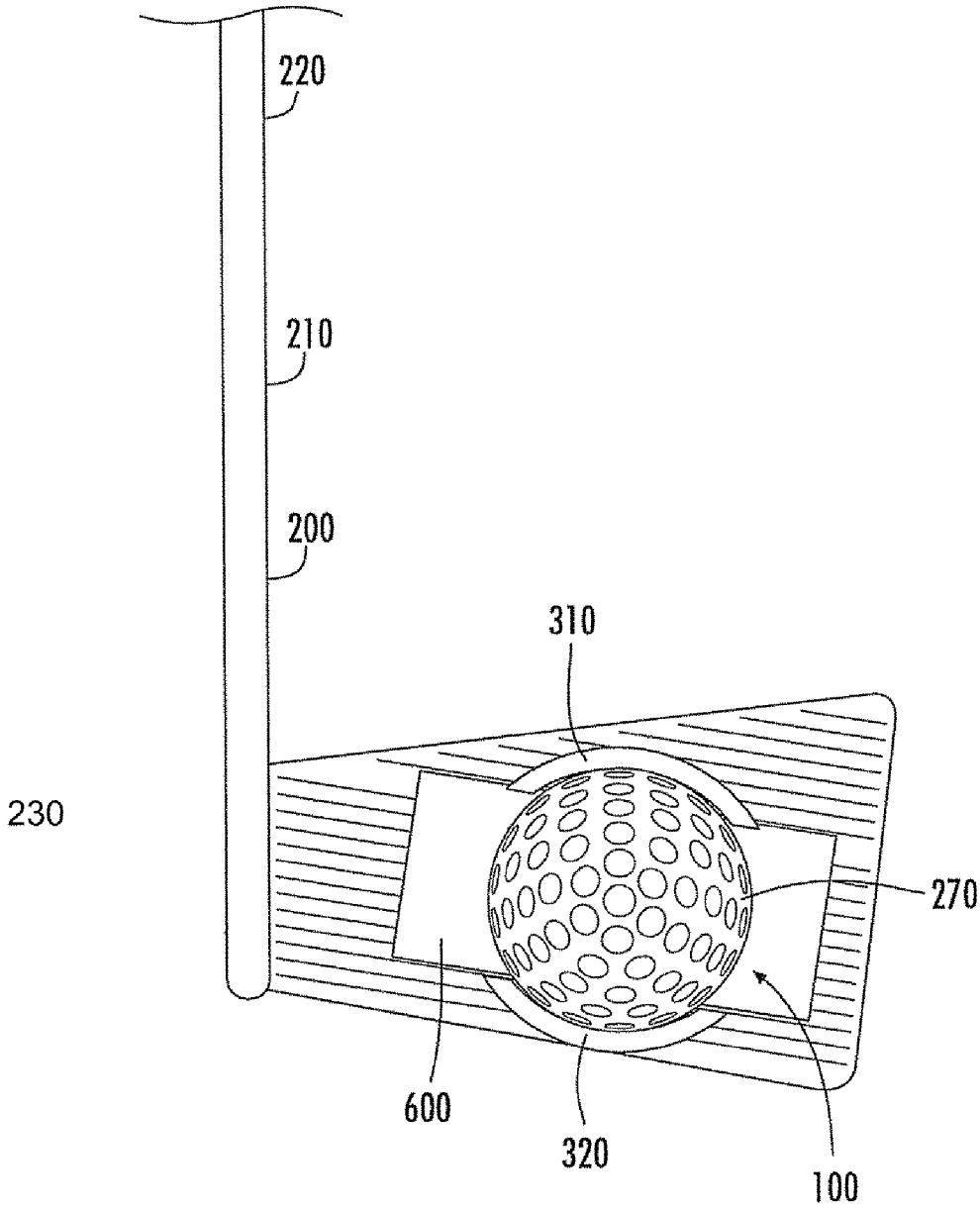
FIG. 3C is a front view of the club or a golf club in FIG. 3B.

FIG. 1 illustrates a modern and commercially available prior art golf club 200. The golf club 200 includes a shaft 210 having an upper portion 220 (that can include a gripping structure) and a lower portion 230. Attached to the lower portion 230 of the shaft 210 is a head portion 240. The head portion 240 has a flat club face 250 which has linear etchings 260 (shown in FIG. 3A) to create traction when a projectile 270 strikes the club face 250. It is preferable that the head portion 240 is attached to the shaft 210 at an angle.

FIG. 2A illustrates a preferred embodiment of the holder 300. The holder 300 shown in FIG. 2A includes an upper curved surface 310 and a lower curved surface 320 that form a shaped recess 330. The shaped recess 330 is of a sufficient size and dimension as to secure and maintain a standard projectile 270 or ball 270 (shown in FIG. 2B). Moreover, these curved surfaces 310 and 320 are shaped and configured in a manner which helps correctly guide the projectile 270 off the head portion 240 when released during a properly executed swing. The holder 300 can be molded and/or manufactured from any lightweight and durable plastic, metal, or composite known to those of ordinary skill in the art.

The holder 300 shown in FIG. 2A further comprises a member 350 dimensioned to fit across the club face 250 of the head portion 240. The member 350 is affixed to the head portion 240 through an assembly 399. While the assembly 399 can take various forms, shapes and orientations, the assembly 399 shown in FIG. 2A includes a first clip 360 and a second clip 370. The first clip 360 is configured to wrap around the top of the head portion 240, while the second clip 370 wraps around the bottom of the head portion 240. Located at the distal end of the first clip 360 is an upper spring action finger 380. A lower spring action finger 390 is further located at the distal end of the second clip 370. Both fingers 380 and 390 place enough pressure on the back of the head portion 240 to keep the member 350 taut and secured to the club face 250.

FIG. 2A illustrates an alternative separate or even integral assembly 399 having a mechanism 395 that utilizes in part a bore-through 365 located within the holder 300. The bore-through 365 is placed essentially in the middle of the member 350. Although it can, it is preferable that the bore-through 365 not penetrate the shaped recess 330 of the holder 300. By placing the mechanism 395 into a drilled through portion of the head portion 240, the mechanism 395 catches the bore-through 365 such that the member 350 can be tightened and secured to the club face 250.

Combinations of multiple club fasteners are shown in FIG. 2B. More specifically, FIG. 2B shows use of multiple clips 360 and 370 in addition to use of a mechanism 395 connected to a bore-through 365 within the member 350. Use of these multiple fasteners helps ensure that the holder 300 does not slide or move during use. FIG. 2B further illustrates the assembled apparatus 100 where the holder is attached to the golf club 200 through use of the two above-described fasteners or multiple clips 360 and 370.

Figure 4:
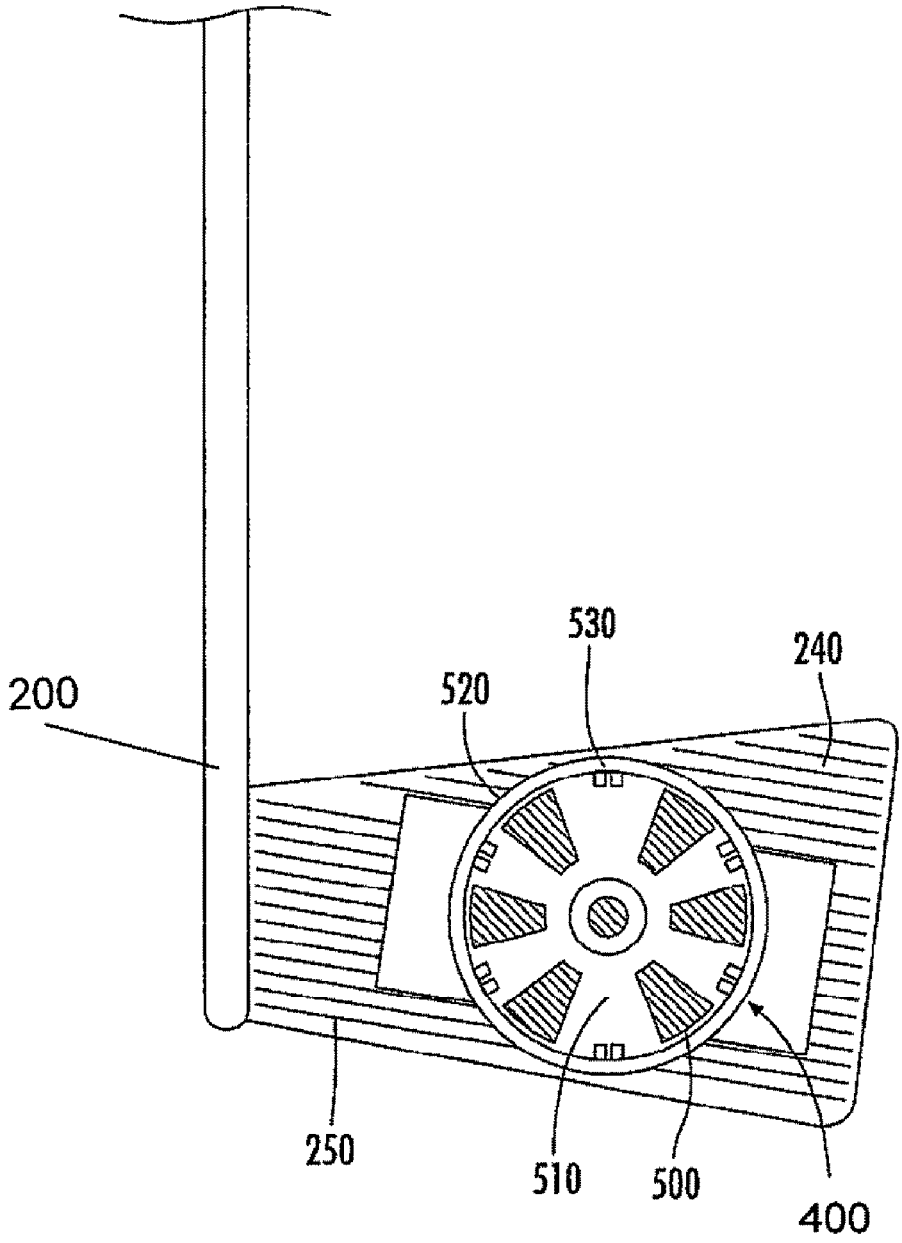
FIG. 4 is a front view of a club or a golf club with a holder according to another aspect of an embodiment of the assembly.

The inventor contemplates an embodiment using a holder 500 that can be calibrated. FIG. 4 illustrates one embodiment of holder 500. By using a more adjustable holder 500 compared to the aforementioned holder 300, the user is able to regulate the size of the shaped recess 510 (i.e., changing the interior diameter), as well as the exact angle on the face 250 of the head portion 240.

By making these changes to the angle of holder 500, the user is able to achieve a precision swing by preventing an improper trajectory of the ball. In addition, by decreasing the interior diameter of the shaped recess 510, the user makes it more difficult to release the projectile 270 during the swing from the apparatus 100 thus progressing in his or her training regiment.

As shown in FIG. 4, this embodiment of the apparatus 100 includes a club shaft 210, a holder 500 that is highly adjustable to allow calibration, and assembly 400 which includes connection of holder 500 to the golf club 200. Holder 500 is preferably hollow and includes an outer housing 520 and an inner housing 530. Both housings 520 and 530 connect at the back portion 540 of the holder 500. Moreover, the housings 520 and 530 should be aligned and made of a flexible and pliable material.

Placed between both housings 520 and 530 is a plurality of cable strings 560 which connect to the back portion 540 of holder 500. Likewise, these cable strings 560 are connected to a tightening mechanism 570 located proximate to the back portion 540. Through tightening the cable strings 560 through the tightening mechanism 570, the inner diameter of the shaped recess 510 of holder 500 is increased. Likewise, loosening the tightening mechanism 570 decreases the diameter.

Alternatively, a holder 500 of FIG. 4 is fastened to the head portion 240 of the golf club 200. While numerous fastening means can be used by one of ordinary skill in the art, it is preferred that holder 500 is fastened through placing a mechanism 395 through a drilled portion within the head portion 240 which connects to a bore-through 365 located at the back portion 540 of the head portion 240.

Once holder 500 is fastened, it is properly adjusted to select the correct inner diameter of the shaped recess 510. This is accomplished through pulling and tightening (or in the alternative loosing and releasing) multiple cable strings 560 within the outer and inner housings 520 and 530 of holder 500. Once these strings are tightened, they are secured via a tightening mechanism 570 proximate to the back portion 540 of holder 500. In addition, the shape and dimension of holder 500 can be further calibrated through moving of the mechanism 395 (either clockwise or counter-clockwise) to alter the shaped recess 510.

Figure 5:
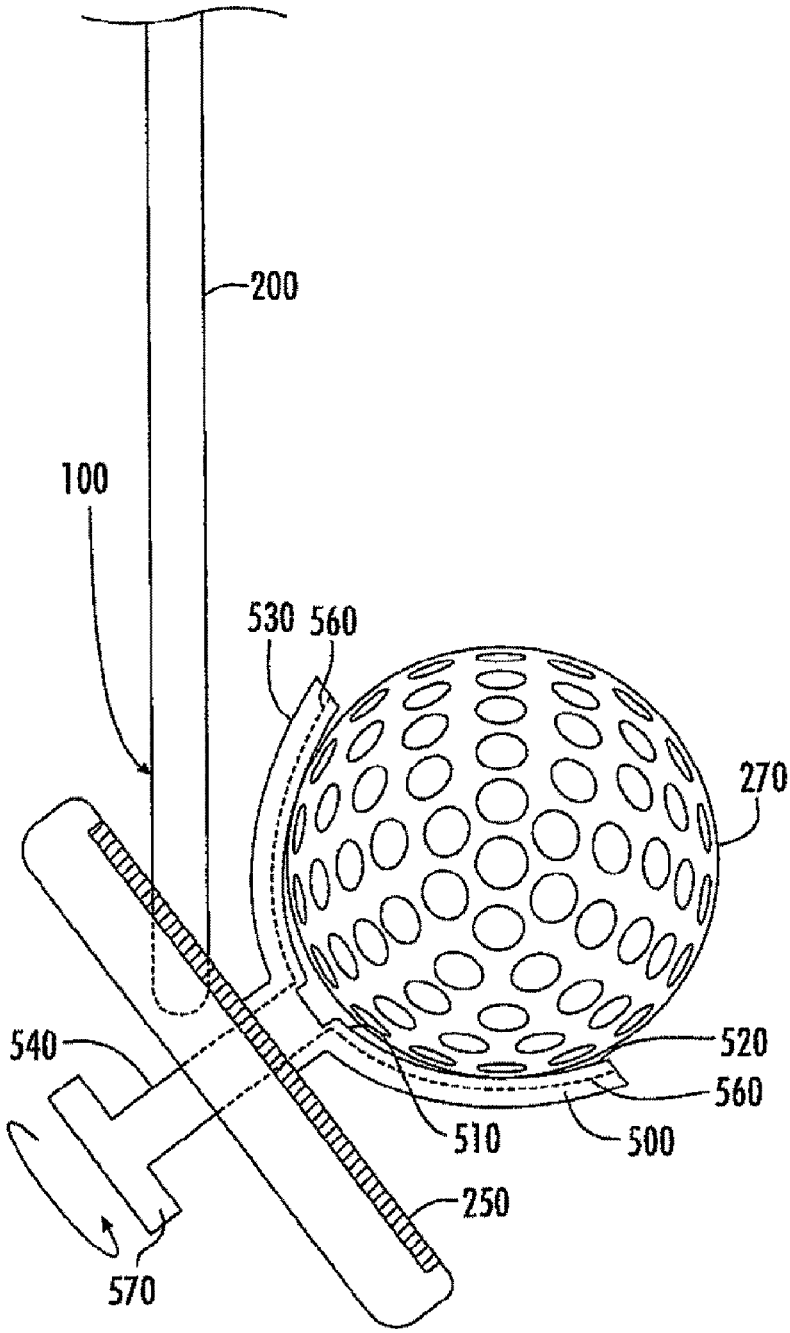
FIG. 5 is a side view of the club or a golf club of FIG. 4.

As further shown in FIG. 5, the apparatus 100 that connects holder 500 with the head portion 240 is a mechanism 395. As previously discussed, the mechanism 395 can be placed through a drilled through portion of the head portion 240 or into a predetermined aperture found within a location of portion 240. One end of the mechanism 395 can be inserted into aperture or bore-through 365 located within the back portion 540 of holder 500. Mechanism 395 may act in concert with tightening mechanism 570 to provide for an ability to adjust the diameter of holder 500. Thus, a movement one way or another of mechanism 395 is operable to change or alter the interior diameter of the shaped recess 510. A changed or altered interior diameter of a shaped holder will become a new force setting of predetermined release for a ball that is positioned or gripped within the recess. The interior diameter setting will partly determine the force and direction required to allow a release of a projectile when a force caused by motion of apparatus is in operation.

In addition to creating a predetermined inner diameter size or a predetermined shape of recess 510 which in turn effects a final position or positioning of a ball (when the ball is partially immured within a holder), the apparatus 100, 700 or 800 for example, can be operable for an angle of the holder relative to a fixed position of the shaft. An adjusting mechanism may be included to alter or allow for a predetermined angle of holder 500 before a swing motion. This can be done in one way by having a flexible or bendable back portion 540. Back portion 540 can also be integral as part of tightening mechanism 570 can be manipulated to set a predetermined angle for ball release in a motion.

Figure 6:
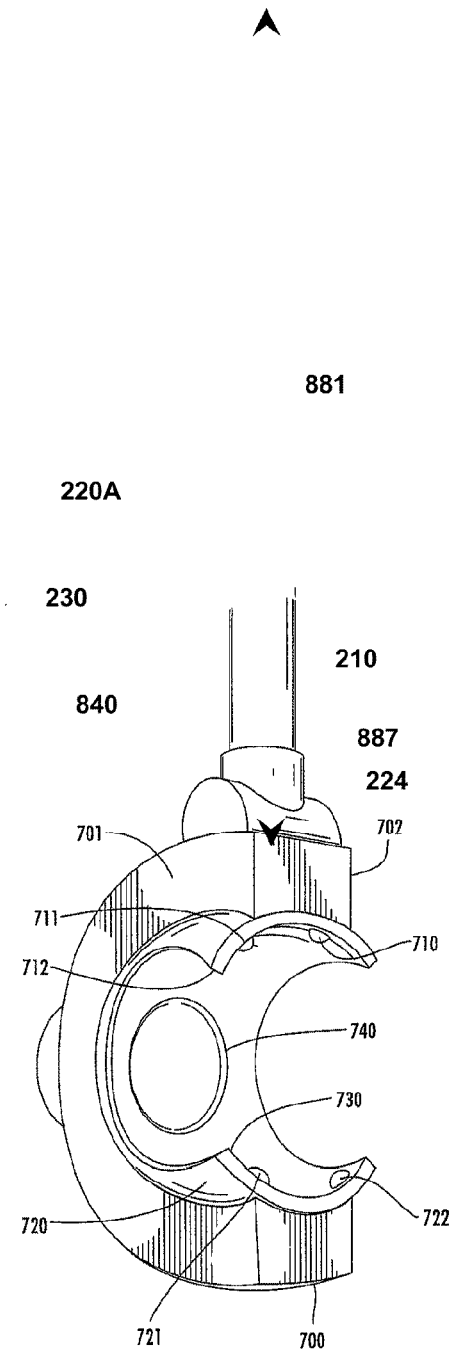
FIG. 6 is a perspective view of a holder and shaft portion according to another aspect of an embodiment.
Figure 7:
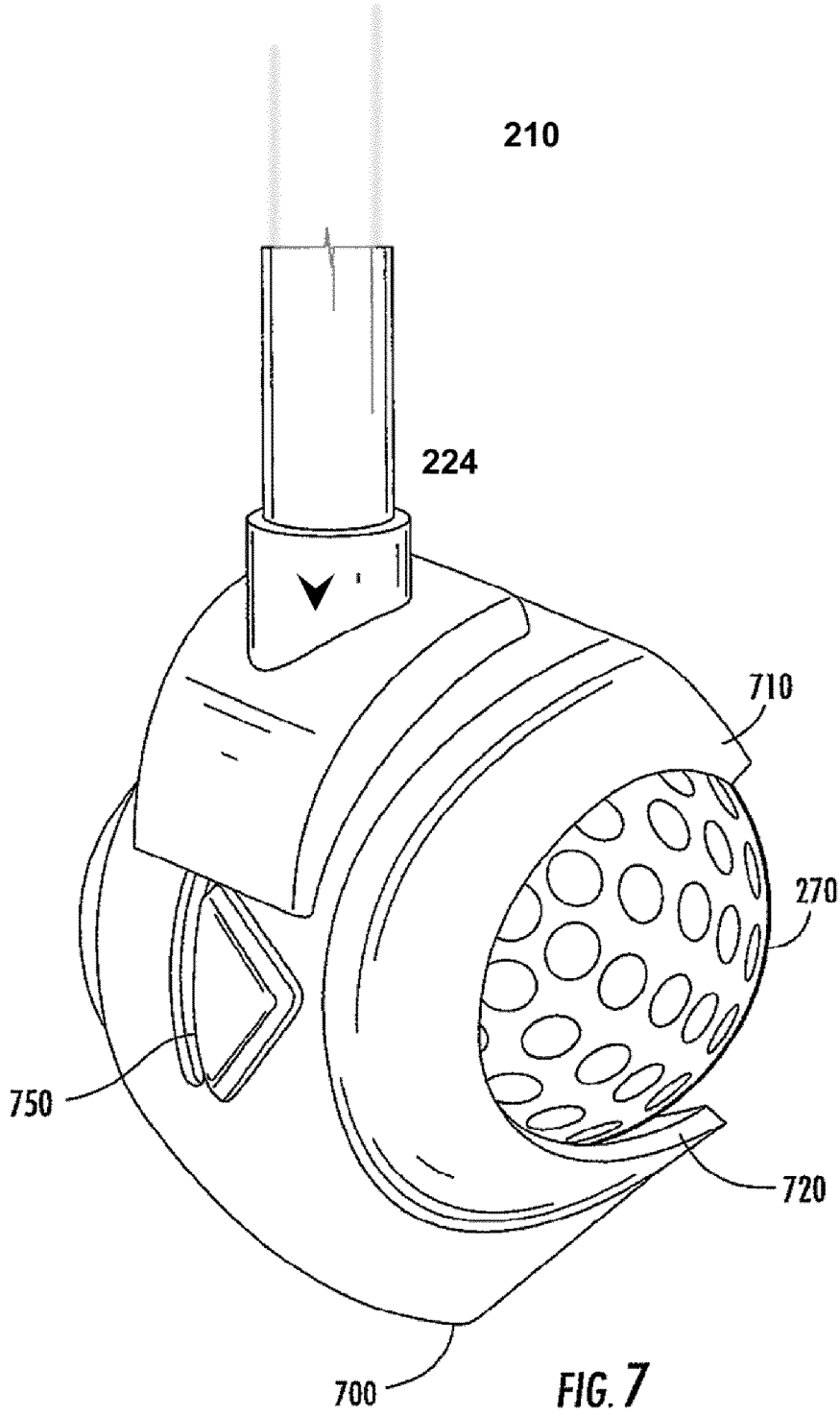
FIG. 7 shows a perspective view of one side of the apparatus shown in FIG. 6.

Another embodiment contemplated by the inventor, apparatus 100 having an assembly 700 or 800 for example, can include an arrangement where the head portion 240 and holder 500 form a single integral member such as (but not limited to) holder 700. FIGS. 6 and 7 offer perspective views of the single-piece holder 700. As shown in FIG. 6, holder 700 can include an upper curved member 712 and a lower curved member 720 which form a shaped cup 730. Both members 712 and 720 can be found in one example to substantially reflect or mimic a surface shape of a ball to be held in a position between members 712 and 720. Members 712 and 720 may include a first side edge 701 and a second side edge 702.

An adjustment mechanism attached to the holder structure 500 or 700 will allow a user to change a current diameter length 1005 (see FIG. 15) which can be defined as a distance between opposing ball holding elements 710, 711, 721 and 722, for example.

In one example like shown in FIG. 7 there is located on an upper curved member 712 two holding elements 710 and 711. Likewise, positioned on a lower curved member 720 are two similar holding elements 721 and 722. The shaped cup 730 can be formed of either a single-piece holder 700 or formed by a multiple holder of members to form a holder like holder 700 or another. The inventor contemplates almost any holder that can be formed, shaped or made to be shaped (such as for example triangular, rectangular or poly-angular in shape or form) that is operable for including a mechanism adjusting various ball holding elements that may substantially parallel, substantially mirror, or substantially contour a projectile's surface and/or complement a shape of a ball or other projectile it holds. Thus a position operable for holding a ball to allow for a predetermined restriction of free movement of the ball can be created by an adjustment or movement to a predetermined position of movable mechanism or movable knob 750 by a user before a swing of the assembly with a ball 270 or projectile 270 placed between a holder 700, holder 500 or the like.

These ball holding elements (710, 711, 721 and 722) assist in holding and maintaining a projectile 270 within any club holder, club holder 500 and/or holder 700 or the like during the swing movement. In addition, a circular ring 740 can be added and located in the shaped cup 730 and can further assist in holding the ball in a proper position.

FIG. 7 illustrates one way for calibrating the club holder 700. As shown in FIG. 7, there is a movable mechanism or movable knob 750 attached to club holder 700. By moving the mechanism 750, in this case by turning it, the user can adjust various ball holding elements (710, 711, 721 and 722), if present, by any combination depending upon configuration, and with or without the aid of a circular ring 740. The movement of mechanism 750 may further provide more or less shape modification of cup 730. This helps alter how the club holder 700 grips the projectile 270 or ball 270. Calibrating the movable knob 750 will change the circumstances under which the projectile 270 will release from the golf club 200 when the user is taking a proper training swing.

A passive or active sensor can be added to any of the assemblies or holders such as assembly 800, for example that can be an additional releasing device. In addition in FIGS. 4 thru 17, a shaft can be combined to form one single device or apparatus 100. Apparatus 100 can include a shaft 210 combined with any of the various holders shown or not.

Once holder 500 or 700 or the like is calibrated by a user, a projectile 270 can be placed within the adjusted recess 510 ready for a swinging operation. The user then sets up in a regular stance, takes a normal back-swing and down-swing and then focuses on releasing the projectile 270 from holder 500 or 700 or the like. The calibrated holder and the movement of the assembly in combination allows for a release of the projectile 270 when a predetermined force level is met during the motion of apparatus 100. A predetermined force vector by way of the apparatus 100 can aid a user to accomplish a correct golf swing when the user later swings a golf club that does not have an apparatus 100.

Figure 8:
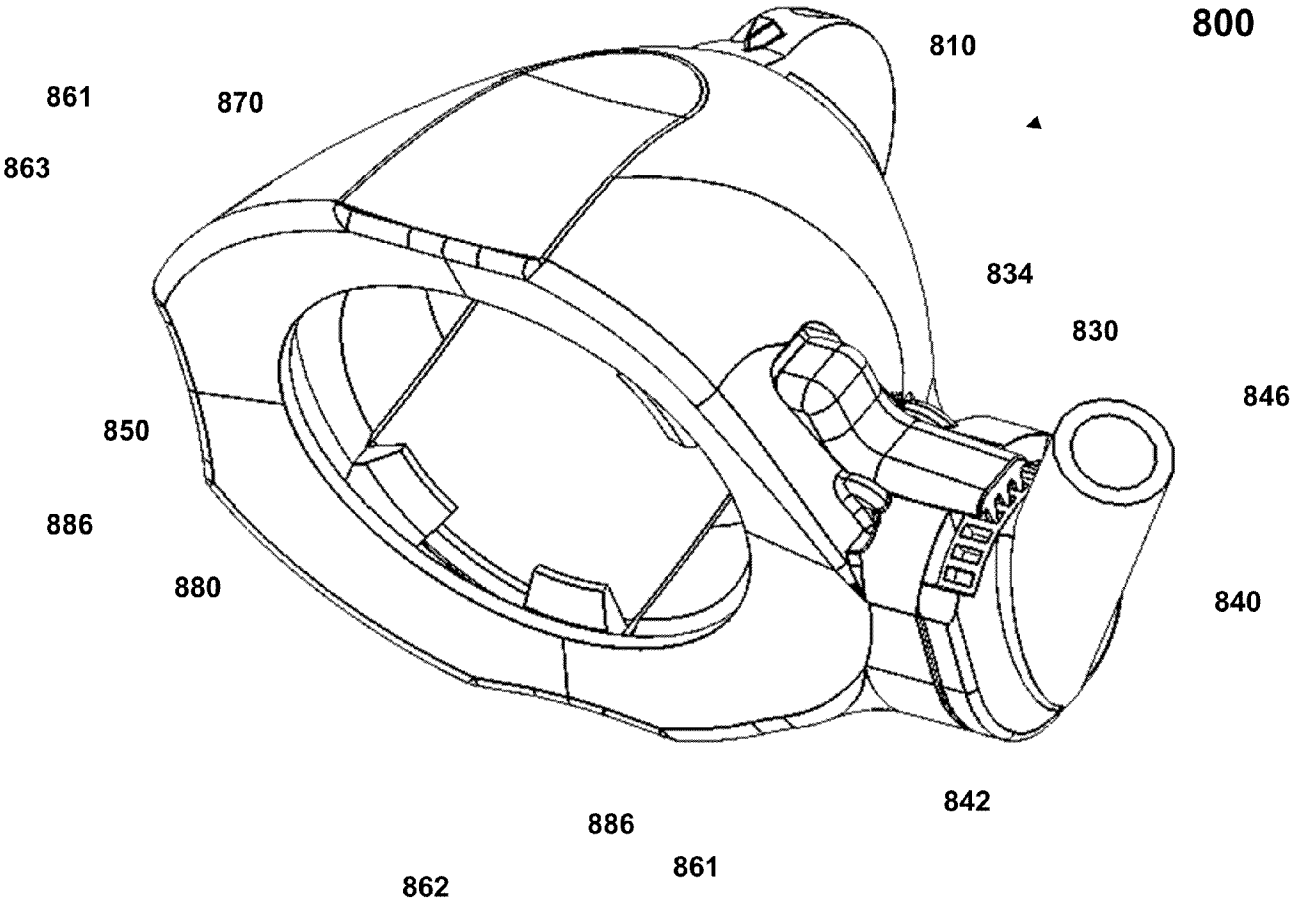
FIG. 8 is a perspective view of a holder portion detached from shaft 210 according to another aspect of an embodiment.
Figure 9B:
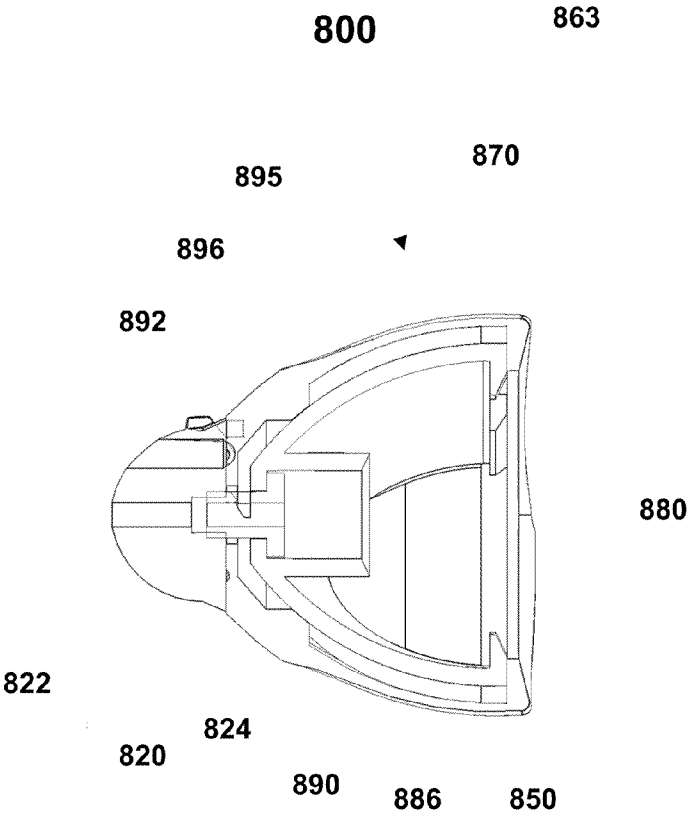
FIG. 9B is a cut side view of the holder portion of FIG. 8.
Figure 9A:
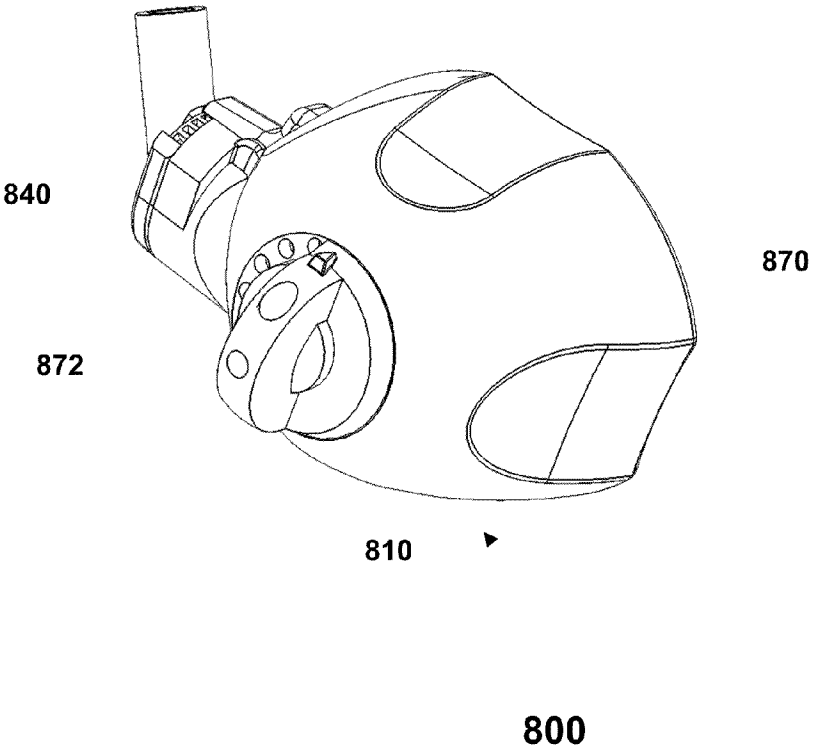
FIG. 9A is a second perspective view of the holder portion of FIG. 8.
Figure 10:
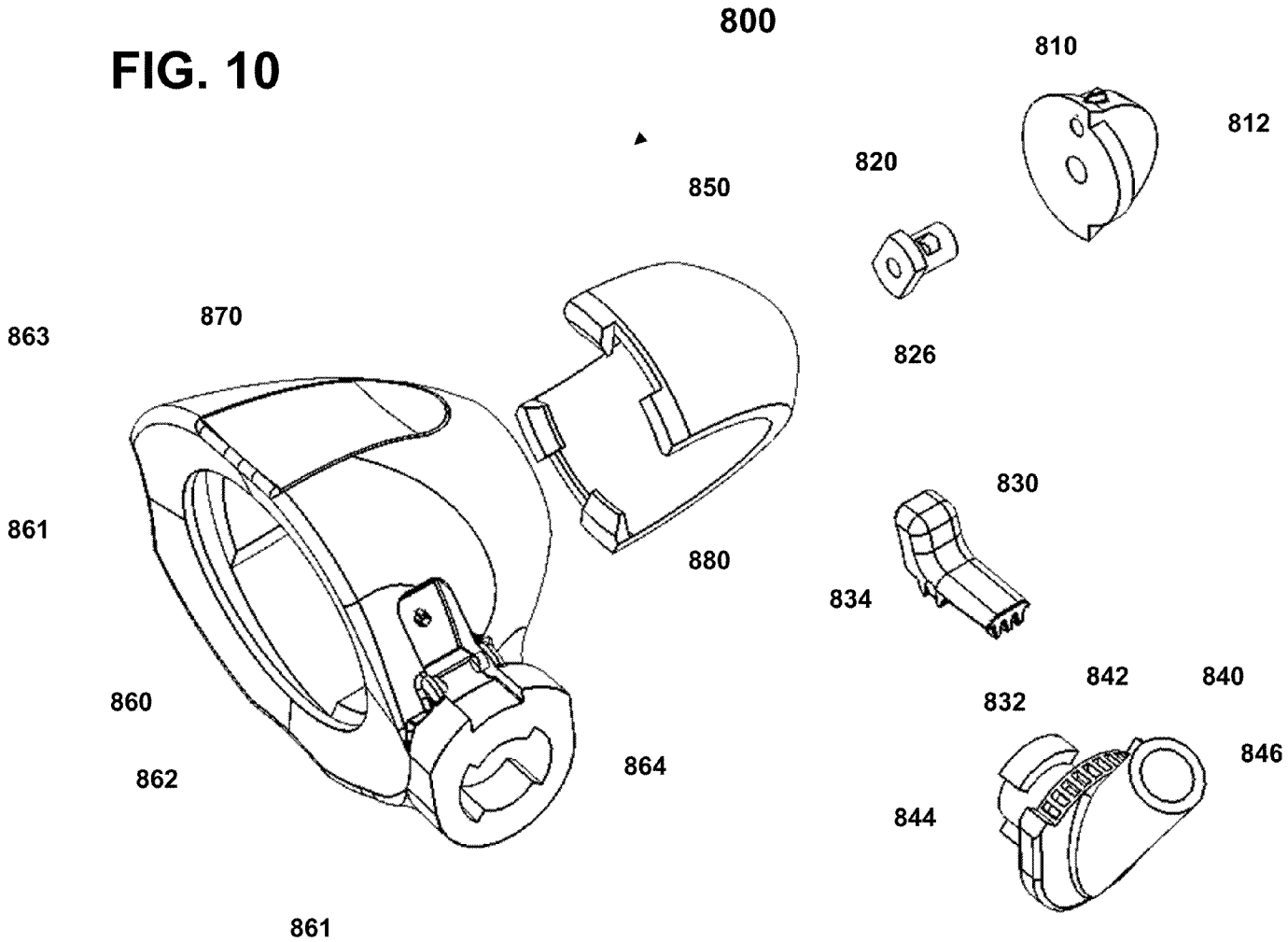
FIG. 10 is a perspective exploded view of the parts of the holder shown in FIGS. 8 and 9.

In another embodiment, as seen in FIGS. 8 though 13, the assembly 800 includes a dial 810, pin 820, catch 830, and hosel 840. In this embodiment, the holder 850 is enclosed in the recess 860 of club head 870. Hosel 840 is attached to club head 870 with male connector 844 and female connector 864.

The hosel 840 is made to be attachable by adhesive, soldering or fitting to a club shaft through hosel cavity 846, or alternatively is manufactured with a club shaft as a single unit. The holder 850 is preferably made of a slightly flexible and pliable material. The holding elements 880 may be made of the same material as the rest of the holder 850, but in any event should be made of a substance that has a sufficient strength to hold or grip a projectile when one or more holding elements are pressed against the projectile with sufficient force. The club head 870 is made of a material of appropriate hardness and inflexibility, such as hard plastic or light metal. The pin 820 is likewise made of a material of appropriate strength and inflexibility, such as hard plastic or light metal.

A hosel is the part or portion of the club head 870 to which a shaft is fitted and secured. The hosel 840 is either a separate unit that is later attached to club head 870 or formed as an integral portion of club head 870. In either format, the hosel facilitates or allows a shaft 210 to be attached to a club head. A hosel's design and final placement or attachment to a club head will contribute and be integral to the balance, feel and power of a club. A hosel may have a hosel cavity 846 that allows insertion and attachment of lower portion 230 of shaft 210. Hosel cavity 846 does not have to pass through the hosel from end to end but may have an aperture end portion that seats and/or supports the shaft end. An epoxy may be inserted within hosel cavity 846 and the shaft inserted for permanent attachment. A screw or any known fastening device(s) may be substituted for epoxy to provide an alternative attachment scheme. For example a screw or any known fastening device (s) may provide a tension against the shaft lower portion 230 and hosel to maintain firm contact of the attachment of the shaft 210 within a hosel cavity so minimize or eliminate any undesired movement of the shaft relative the hosel. Some hosels are minimal in size relative to a club head in order to minimize its mass relative to the size of the club head in order to lower the center of gravity of the club with respect to the club face 863 for a better ball distance result. The hosel may also be a male connector rather than a female connector, with the connecting shaft having a female connector.

Figure 11:
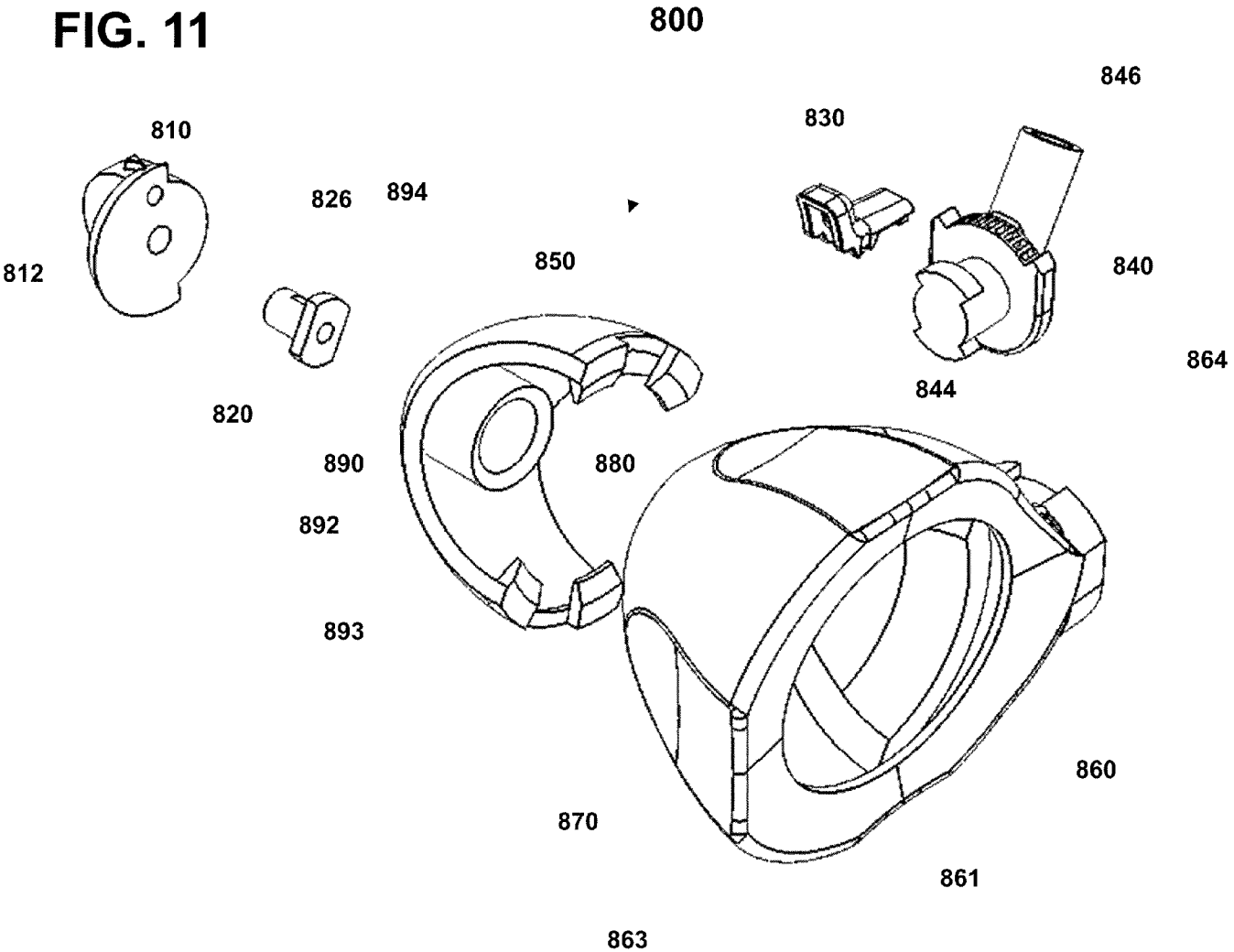
FIG. 11 is a second perspective exploded view of the parts of the holder shown in FIGS. 8 and 9.
Figure 13A:
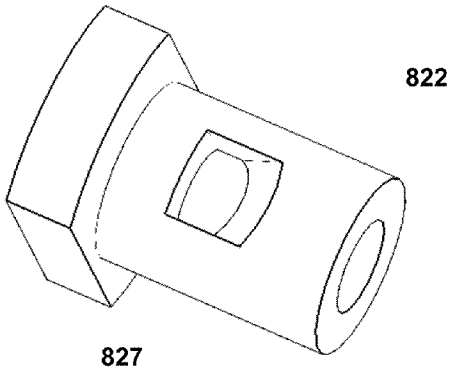
FIG. 13A is a view of a connecting pin from the holder portion or holder assembly of FIG. 8 with a whistle function.
Figure 13B:
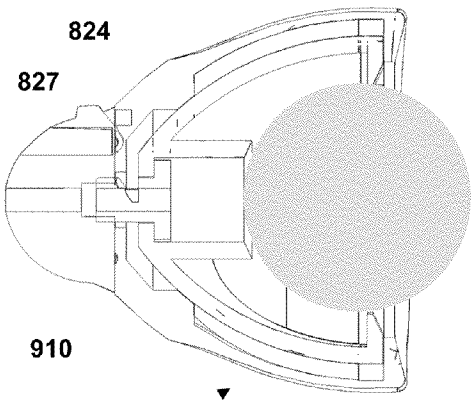
FIG. 13B is a side cut view of the holder portion or holder assembly shown in FIG. 8, with a ball.
Figure 13C:
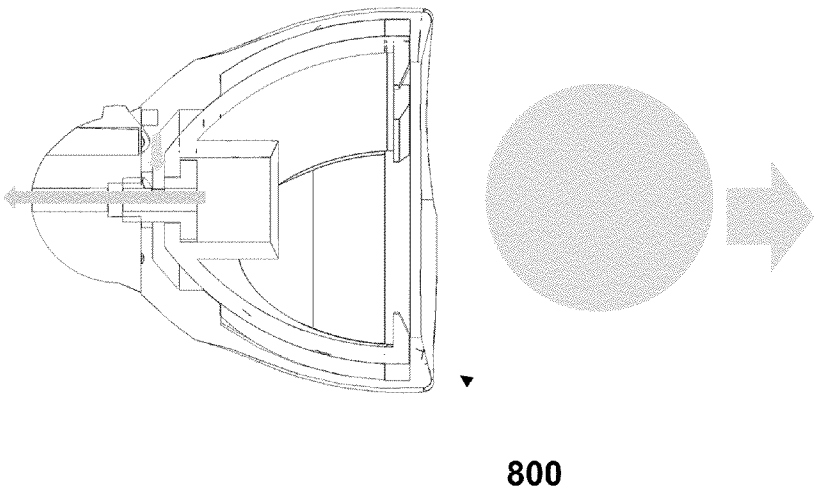
FIG. 13C is a side cut view of the assembly shown in FIG. 8, with a moving ball.

In this embodiment, the holder 850 has four holding elements 880 that hold a projectile placed in holder 850. However, the device can function with any number of holding elements. Each of the holding element's 880 contact area 886 with a golf ball (not shown) is wider than two of the golf ball dimples. As seen in FIGS. 11 and 13A, holder 850 has an opening 892 sufficient for pin shaft 822 of pin 820. As seen in FIGS. 13B and 13C, pin head 824 rests fits against back wall 896 of holder cylinder 890. Rim 893 of holder cylinder 890 serves as a backstop for a projectile placed in recess 860.

Cheeks 861 in recess 860 on either side of projectile holder 850 prevent projectile holder 850 from rotating inside recess 860 while allowing projectile holder 850 to move toward or away from the face 863 of club head 870.

Figures 12A, 12B:
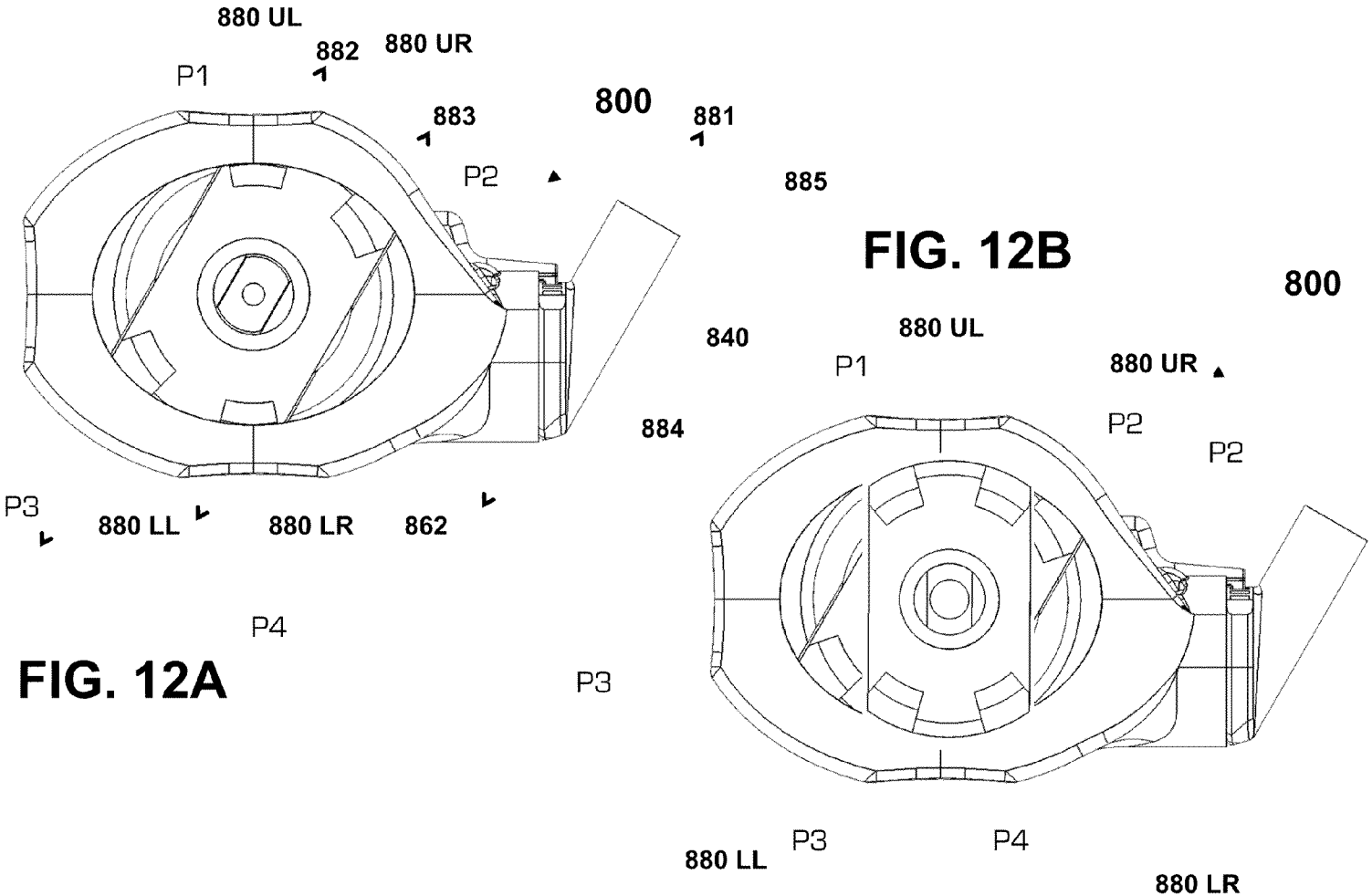
FIG. 12A is a front view of the holder portion detached from shaft 210 as shown in FIG. 8.
FIG. 12B is a front view of the holder portion detached from shaft 210 as shown in FIG. 8.

FIG. 12A shows one of the preferred positions for holding elements 880. Lower left element 880 LL and upper left element 880 UL form an imaginary line 882 that is substantially parallel to the imaginary line 881 connecting the center of distal end 885 and the center of proximate end 884 of hosel 840. Likewise, lower right element 880 LR and upper right element 880 UR form an imaginary line 883 that is substantially parallel to imaginary line 881. The setting of the holding elements 880 at these positions assure that the elements 880 will exert a substantially symmetrical holding force on a projectile when the club is swung, thus allowing the projectile to exit the device properly.

Figure 6A:
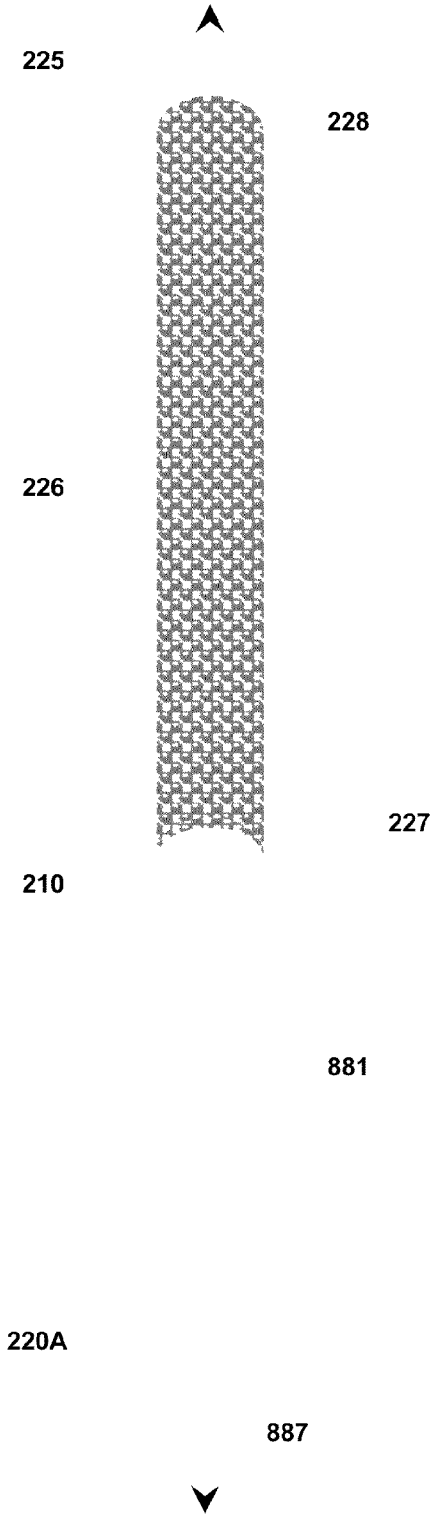
FIG. 6A is a continuation of the shaft portion shown in FIG. 6.

The position and angle of imaginary line 881 are based on the assumption that any shaft as shown in FIGS. 6 and 6A, for example, used with the assembly 800 is straight and fits well in hosel cavity 846, and that therefore the center of the shaft's 210 distal end 225 and the center of the shaft's 210 proximate end 224 (See FIG. 7) creates an imaginary line 887 that is in substantially the same position as imaginary line 881. However, if the shaft 210 is straight but attaches to hosel 840 at an angle, the angle of hosel 840 is not the determinant of the position of imaginary line 881, and instead imaginary line 881 should connect the center of the shaft's 210 proximate end 224 with the center of the shaft's 210 distal end 225. And, if the shaft is not straight, imaginary line 881 should instead connect the center of the proximate end 227 of the gripping portion 226 of the shaft 210 and the center of the distal end 228 of the gripping portion 226 of the shaft 210.

In various embodiments that seek to replicate the swing motion of different types of clubs (for example, a 3 iron or a 1 wood), the shaft angle varies. Likewise, the imaginary lines 882, 883 in each embodiment will be set at substantially the same angle as the imaginary line 881 in the hosel 840.

If the assembly does not have cheeks 861 (for example in FIG. 15), the holder 850 and holding elements 880 are free to rotate on the plane of the face 863 of the club head 870. When holding elements 880 UL, 880 LL, 880 UR and 880 LR are substantially in the position as shown in FIG. 12A and as described above, during an ordinary swing the golf ball forces on the various holding elements 880 UL, 880 LL, 880 UR and 880 LR (said forces designated P1, P2, P3 and P4) will be essentially identical. However, if the holder 850 and holding elements 880 are rotated from the position shown in FIG. 12A (see, e.g., FIG. 12B), the forces P1, P2, P3, and P4 may not be identical.

Pin 820 connects to dial 810 via screw (not shown), or alternatively dial 810 and pin 820 are a single unit. Pin head 824 has pin threads 826 that fit in and turn inside holder cylinder threads 894 inside holder cylinder 890. As dial 810 turns clockwise, pin 820 pulls holder 850 further into club head 870, causing shoulder 895 to push back against holder 850 and decrease diameter of holder 850 and pull holding elements 880 closer together, thereby increasing the pressure on the projectile being held. Likewise, if dial 810 is turned counterclockwise, holder 850 re-expands and moves further toward opening of recess 860.

Indents 872 in club head 870 line up with bearing 812 on dial, thus stabilizing dial/holder apparatus once the desired amount of pressure is placed on the projectile. In a minor variation of this embodiment, back wall 896 does not exist and holder cylinder threads 894 continue to back end of holder cylinder (not shown), thereby allowing pin head 824 to be completely unthreaded (i.e., separated) and rethreaded from holder cylinder 890. The amount of pressure on the projectile per dial turn can be made more fined-tuned by increasing the number of turn threads per inch in pin threads 826 and corresponding holder cylinder threads 894.

As seen in FIGS. 12A and 12B, the outer rim guard 862 on the face 863 of club head 870 is elliptical, although other shapes can be used.

Figures 12A, 12B:
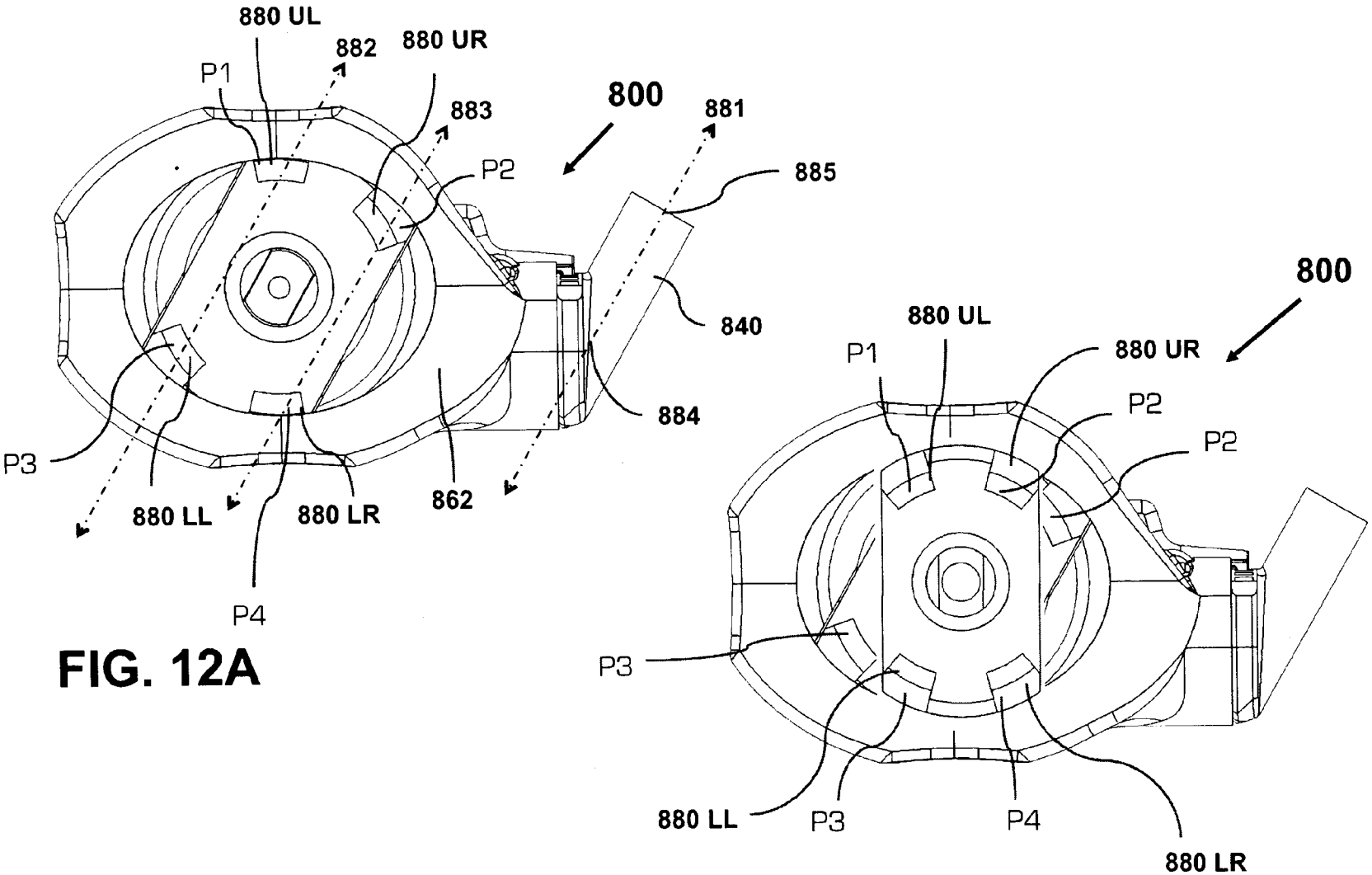
Figure 13A:
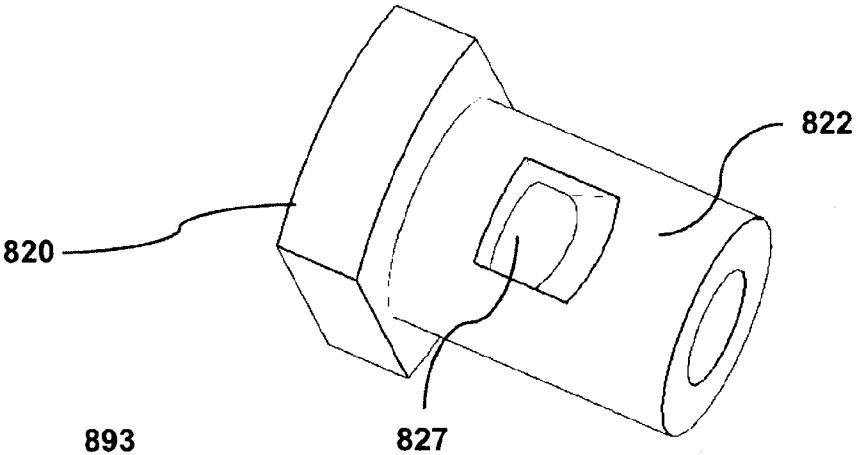
Figure 13C:
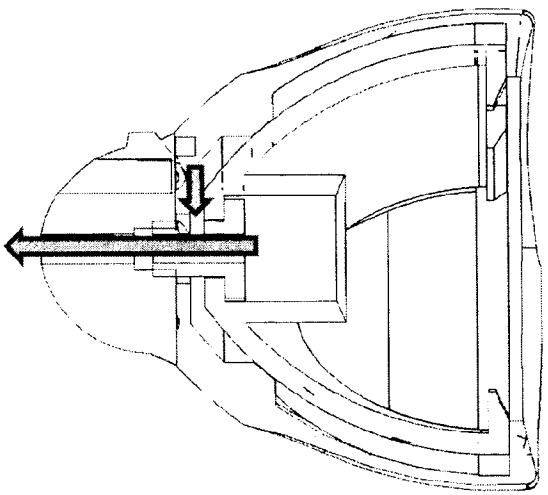
Figure 13B:
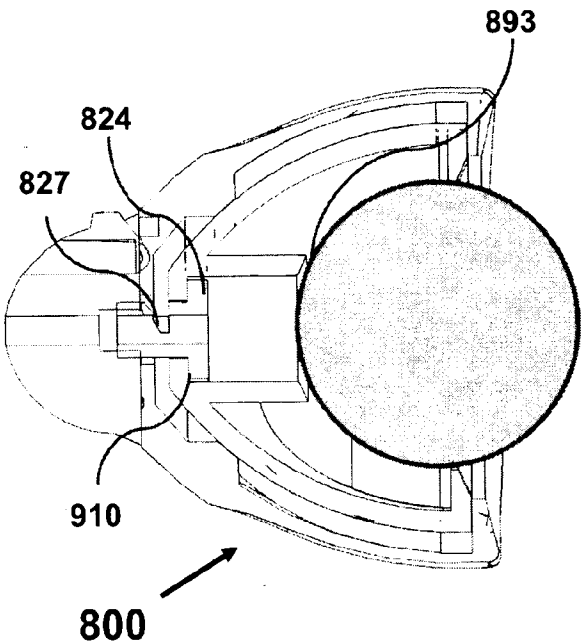
Figure 14B:
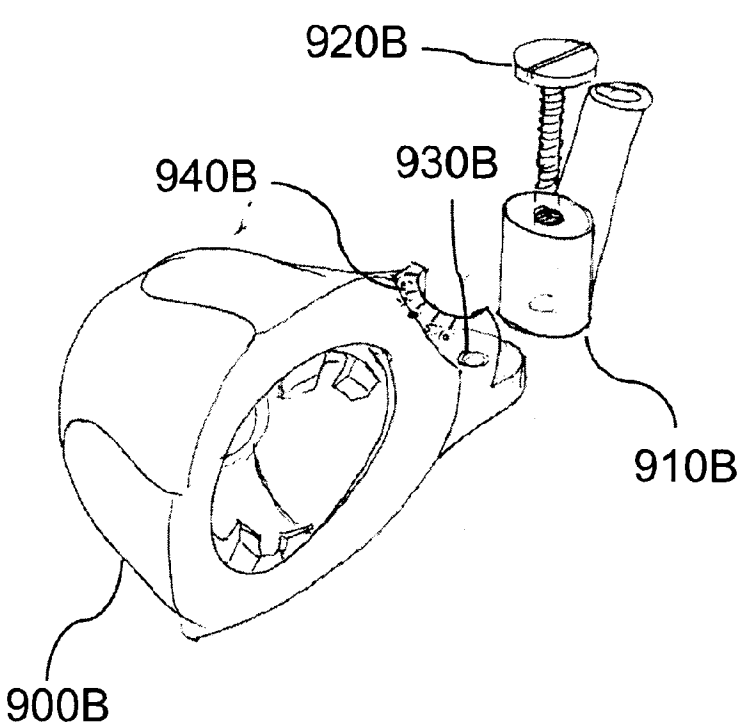
Figure 14A:
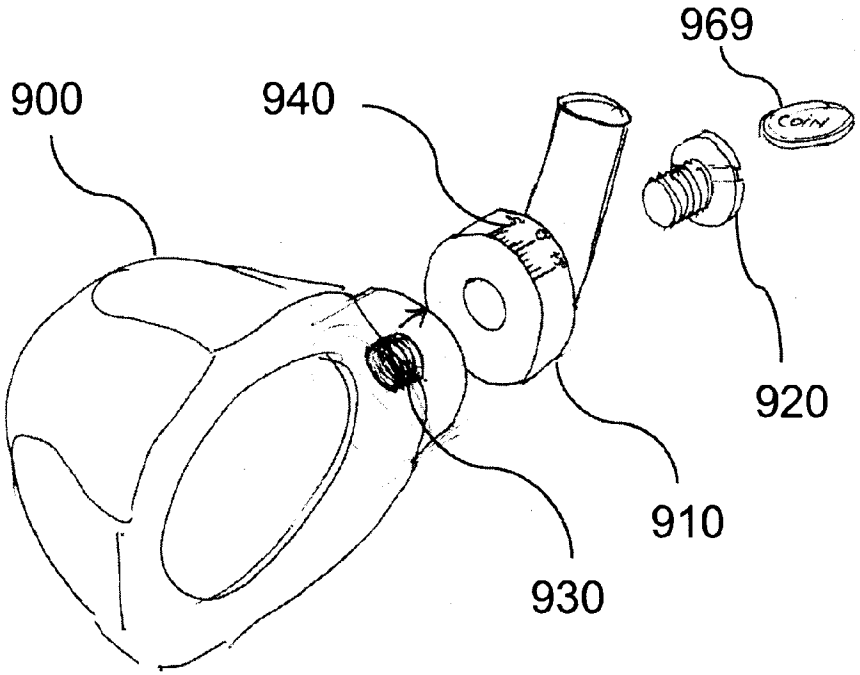

In FIG. 11 and FIG. 12 for example, another aspect of golf club assembly 800 is disclosed and can include a club head 870 having a face 863 with a recess portion 860. Within assembly 800, projectile holder 850 includes at least two or more opposing holding elements 880 that are spaced a first distance setting from one another. A turning mechanism that can include a single element or a plurality of elements such as a dial 810, pin 820, catch 830 or the like (not shown) may be attached to said projectile holder 850 to be operable to fix or set a first distance setting of at least two opposing holding elements 880 from one another. This turning mechanism is also operable to fix or set at least a second distance setting of at least two opposing holding elements 880 from one another. Of course, the first distance setting is different from the second distance setting. The first or a second distance setting is created by manipulating the position turning the mechanism that directly or indirectly applies a force upon holder 850 that increases or decreases the spacing distance between opposing holding elements 880. This first or second distance setting will also create a first or a second holding force upon a projectile 270 or ball 270 placed between two opposing holding elements such as 880 UL and 880 LL for example. Approximately the same situation will occur upon a holder having two other opposing holding elements such as 880 UR and 880 LR. The mechanism that can create the first holding force upon said any projectile 270 will create the second holding force upon the same projectile 270. The first and the second force settings will be different from one another.

As seen in FIG. 12A, hosel 840 is attached to the club head 870. Hosel 840 can include a proximate hosel end 884 and a distal hosel end 885. A first imaginary line 881 connecting the center of the proximate hosel end 884 to the center of the distal hosel end 885 and a second imaginary line 882 connecting a first opposing holding element 880 UL to a second opposing holding element 880 LL (which can make up at least two opposing holding elements 880*xx*) will be substantially parallel to one another; these are first and second imaginary lines 881, 882 as depicted in FIG. 12A.

First imaginary line 881 is also substantially parallel to a third imaginary line 883 found between a third opposing holding element 880 UR of the at least two opposing holding elements and a fourth opposing holding element 880 LR of the at least two opposing holding elements. All three lines will be substantially parallel with one another during a swing of the golf club assembly 800 having a ball 270 placed or fixed into the projectile holder 840 within the recess portion 860.

This particular embodiment could have various other mechanisms to adjust and fix the holding pressure on the projectile. By way of example only, the horizontal pulling function of the pin head and holder cylinder threads could be substituted by having the dial handle set on an inclined circular plane, thereby pulling the holder back when the dial is turned. Or, the area between the recess and the holder could contain one or more inflatable devices that increase the pressure of the holding elements on the projectile when the inflatable device is filled with more air. Or, the holder could be surrounded by an adjustable hose clamp with an accessible tightening screw.

This embodiment also includes catch 830 with projections 832. In its locked position, the projections 832 fit into notches 842, thus preventing rotation of club head 870 relative to hosel 840. When upper end 834 of catch 830 is pushed, the projections 832 lift and allow club head 870 to rotate, whereafter the projections may be pushed into different notches 842, thus locking club head 870 into a different rotational angle relative to the hosel 840. The recess 860 of club head 870 thus can change its angle relative to hosel 840 and the club shaft (not shown).

As shown in FIG. 11, pin 820, dial 810, and holder cylinder 890 have hollow centers, allowing air to flow through the device if a projectile is not resting against rim 893 of holder cylinder. As shown in FIG. 13C, when a projectile is released from club head 870, wind flowing through the device will create a venturi effect, drawing air through sharp hole 827 in pin to create a whistling noise. A user of the device is thereby alerted with a whistle sound if the projectile is released from recess 860 during a swing.

Figure 14B:
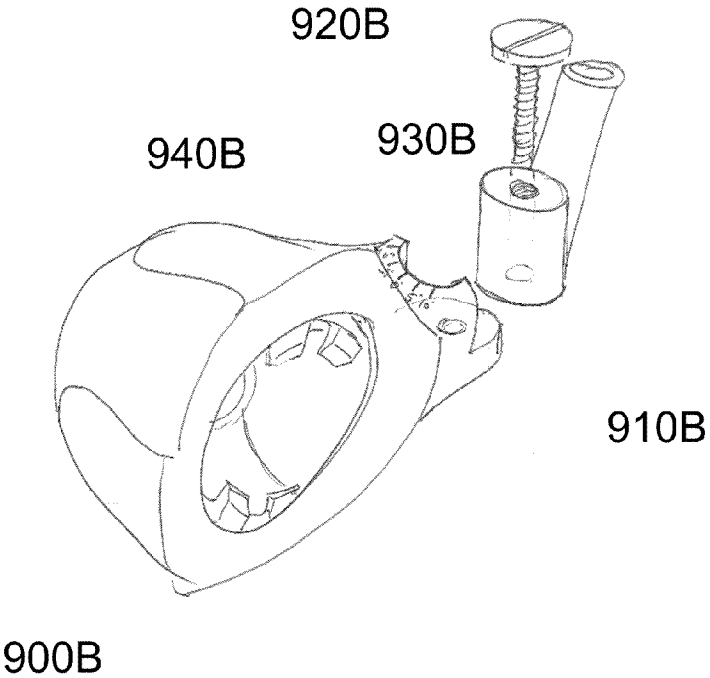
FIG. 14B is a simplified exploded view of a type of the holder portion or holder assembly in FIG. 8, emphasizing an alternative mechanism for adjusting the angle of the club relative to the hosel.
Figure 14A:
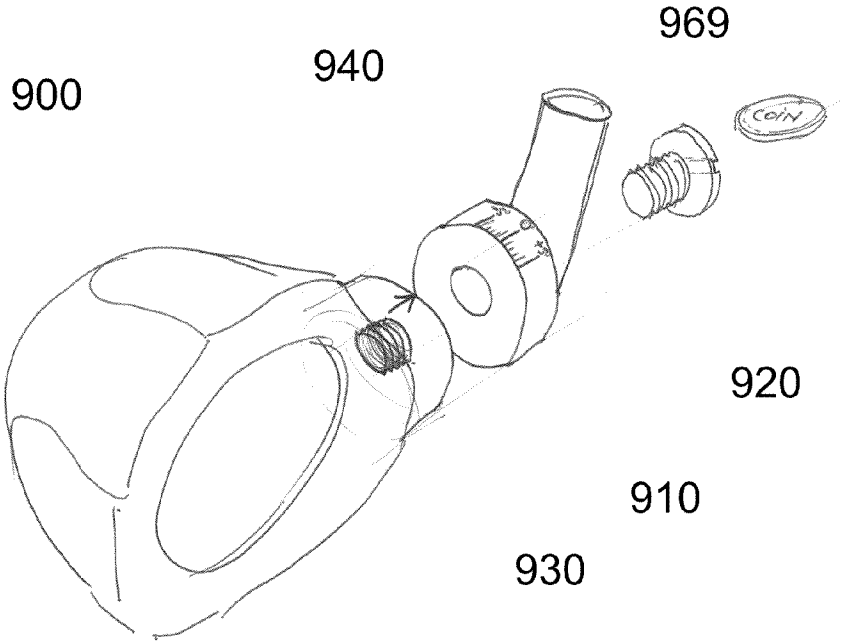
FIG. 14A is a simplified exploded view of a type of the holder portion or holder assembly in FIG. 8, emphasizing an alternative mechanism for adjusting the angle of the club relative to the hosel.

FIG. 14A shows an alternative mechanism for rotating and fixing hosel 910 relative to club head 900. Coin, disk or a turner 969 operated threaded pin 920 passes through hosel 910 and screws into threads 930, thus securing hosel 910 to club head 900 at a predetermined angle. To adjust hosel, threaded pin 920 is slightly loosened, fine scale guide 940 is used to determine and adjust the desired angle of club head 900 relative to hosel 910, and threaded pin 920 is retightened.

FIG. 14B shows another alternative mechanism for rotating and fixing hosel 910B relative to club head 900B. Coin, disk or a turner operated threaded pin 920B passes through hosel 910B and screws into threads 930B, thus securing hosel 940B to club head at a predetermined angle. To adjust hosel, threaded pin 920B is slightly loosened, fine scale guide 940B is used to determine and adjust the desired angle of club head 900B relative to hosel 910B, and threaded pin 920B is retightened.

The fine scale guide 940 can include markings for angles so as to allow the user to increase the difficulty level or change the swing force and acceleration requirements, as well as change the trajectory of the ball (not shown) when the ball is released from the holder 950.

Figure 15:
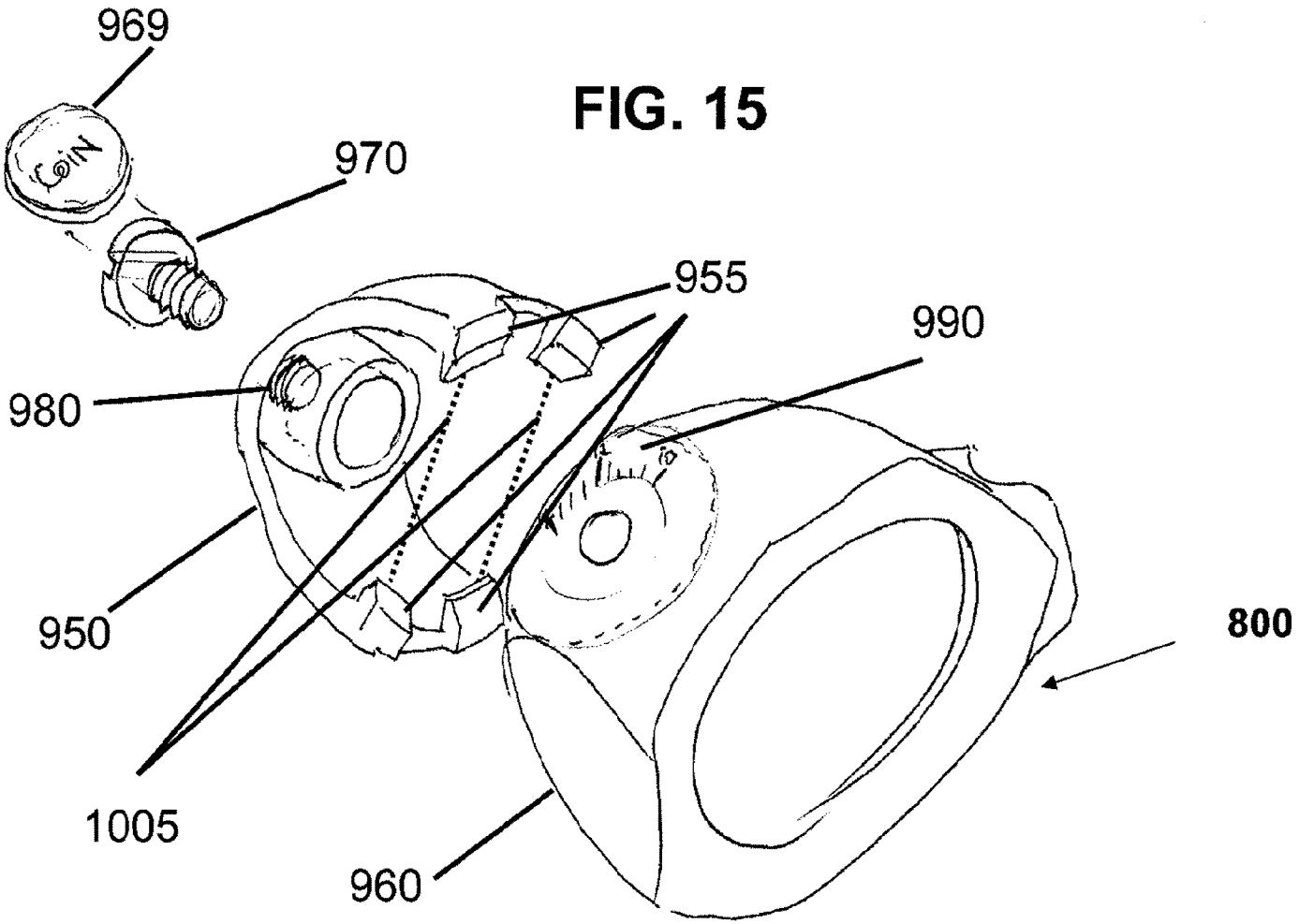
FIG. 15 is a simplified exploded view of a type of the holder portion or holder assembly in FIG. 8, emphasizing an alternative mechanism for adjusting the holding force of the club on a projectile.

FIG. 15 shows an alternative mechanism for moving holder 950 further into or out of club head 960. Coin, disk or a turner 969 operated threaded pin 970 fits into threaded hole in holder 950. By turning threaded pin 970 clockwise, holder 950 is pulled into club head 960, and by turning threaded pin 970 counterclockwise, holder is let further out of club head 960. Fine scale guide 990 allows a user to measure and adjust the amount of force (e.g., in Newtons) that holding elements 955 will exert on a given standard size projectile, by matching the slot in the mating screw with the desired force on the fine scale guide 990.

Figure 16:
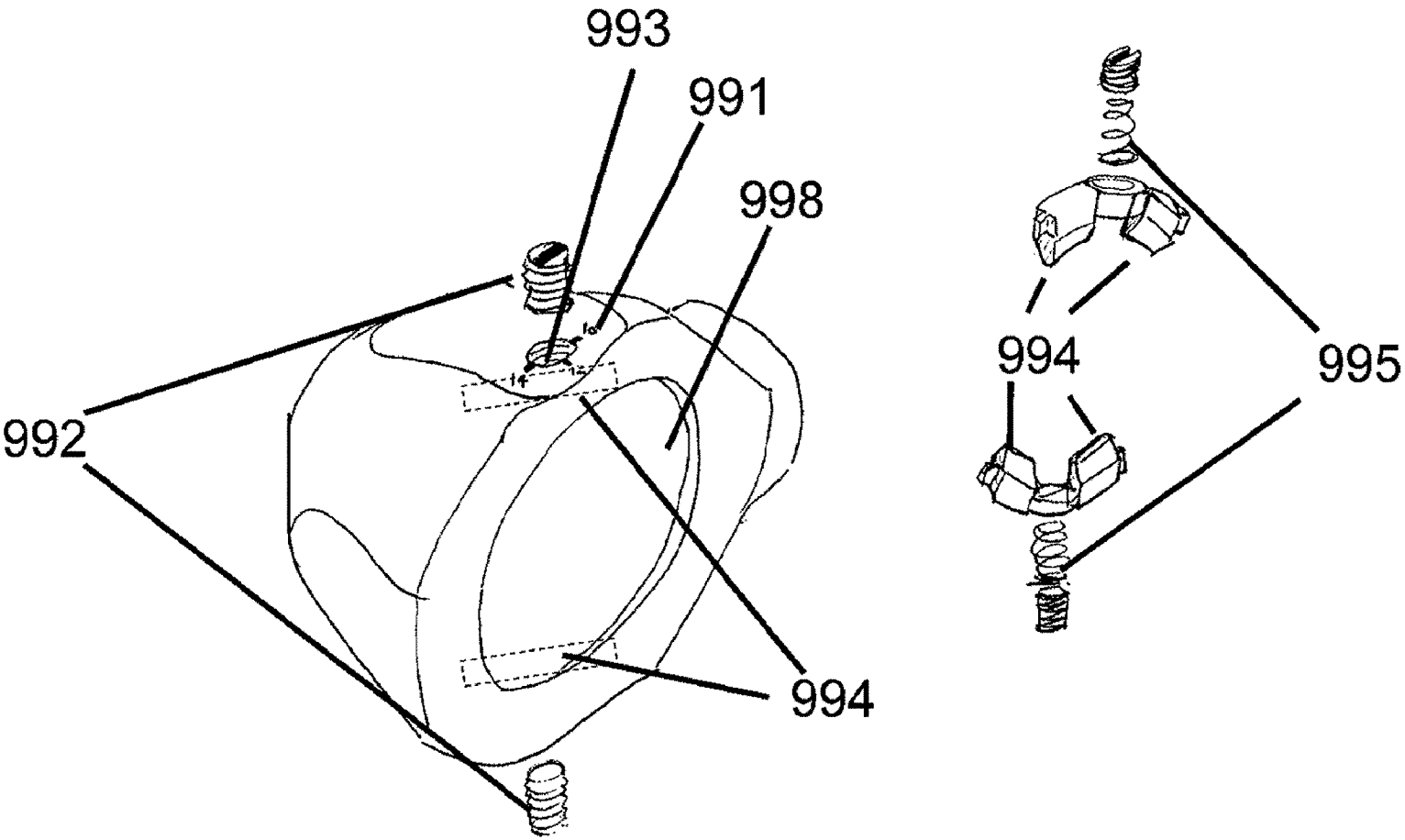
FIG. 16 is a simplified exploded view of a type of the assembly in FIG. 8, emphasizing an alternative mechanism for adjusting the holding force of the club on a projectile.

FIG. 16 shows an exploded view of a mechanism for varying holding pressure on a projectile without the use of a holder 950 like shown in FIG. 15. Holding elements 994 are on spring mounted sliders 995, sliding inside recess 998. As threaded pins 992 are turned in threaded holes 993, holding elements come closer together inside recess thereby increasing the grip on a projectile in recess 998. Fine scale guide 991 may assist user in calibrating grip, i.e., the force vector that will be required to release projectile from recess 998 during swing.

Figure 17:
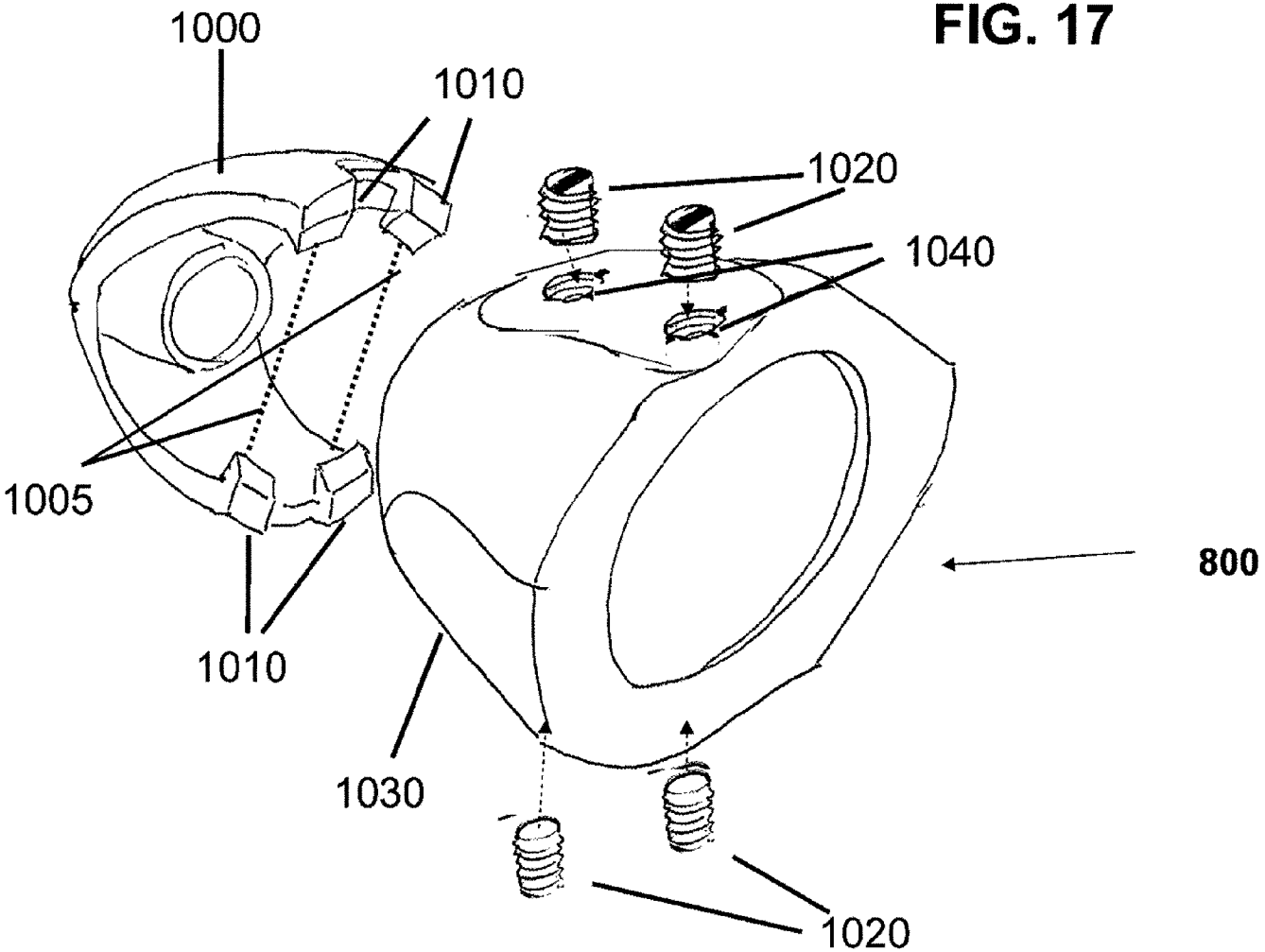
FIG. 17 is a simplified exploded view of a type of the assembly in FIG. 8, emphasizing an alternative mechanism for adjusting the holding force of the club on a projectile.
Figure 8:
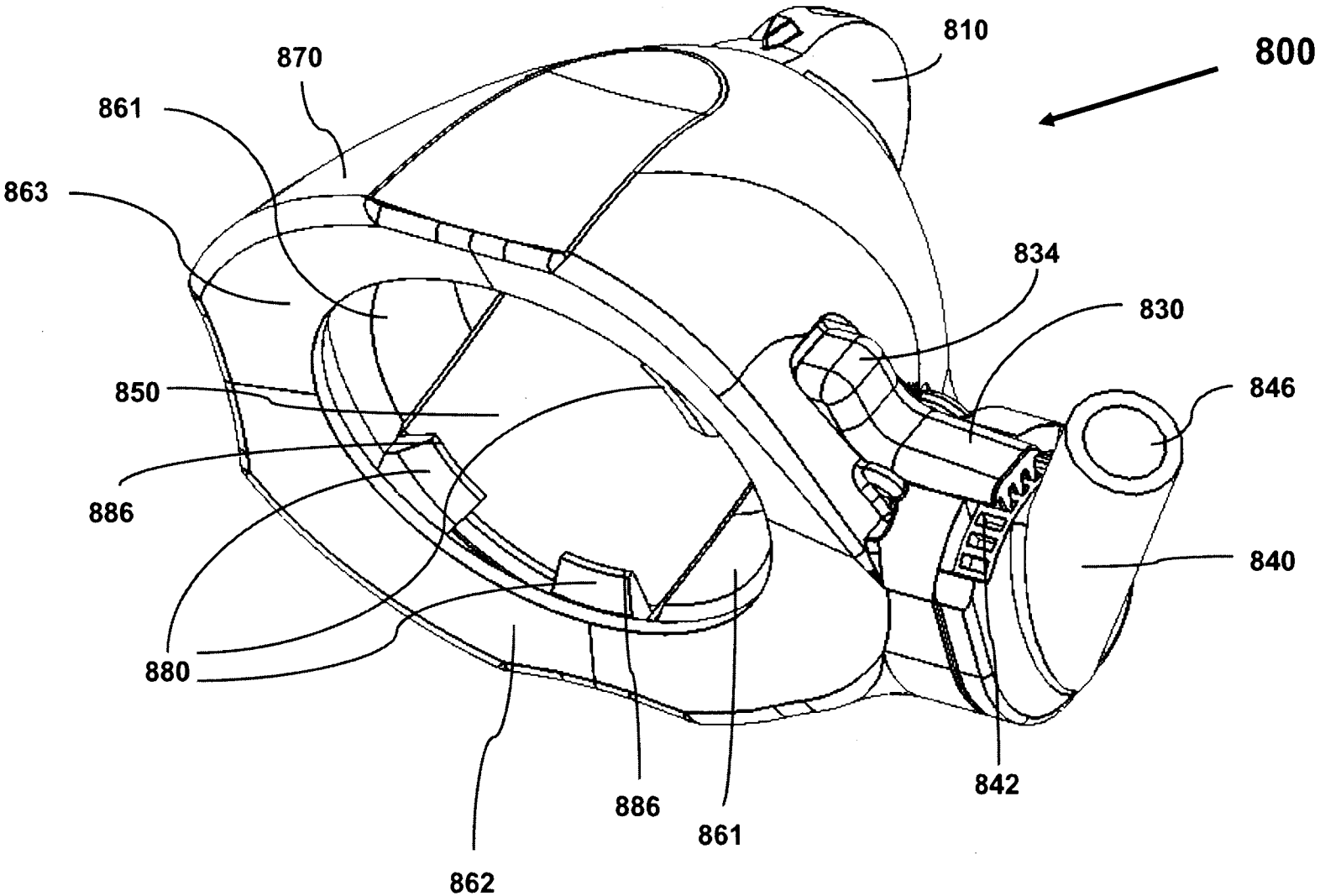
Figure 9B:
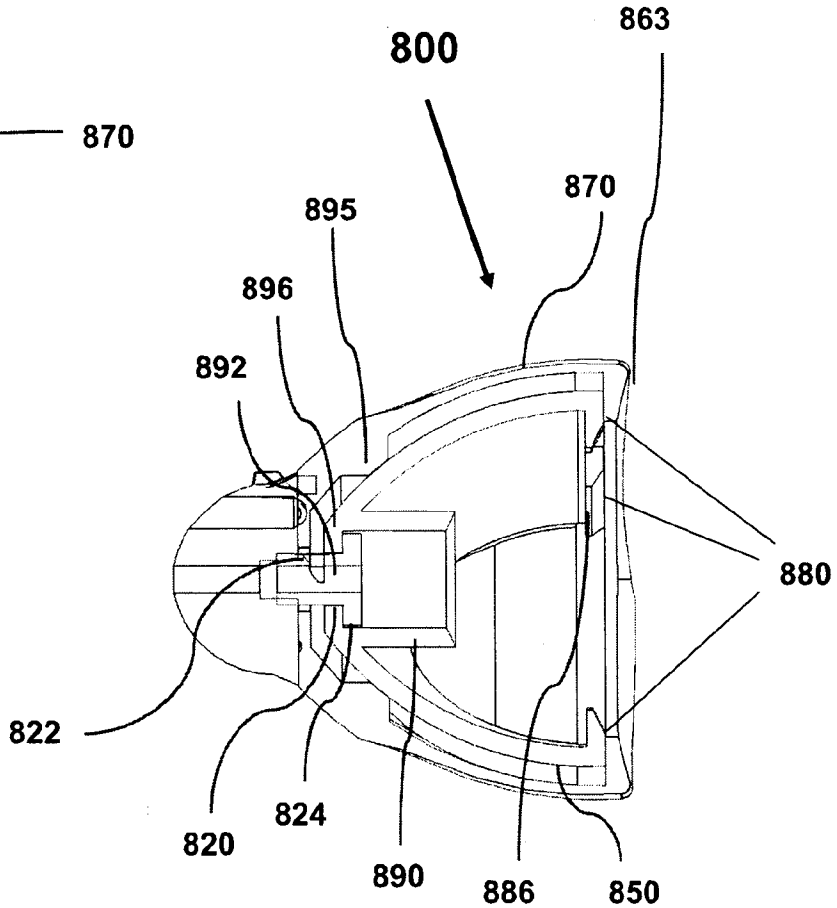
Figure 9A:
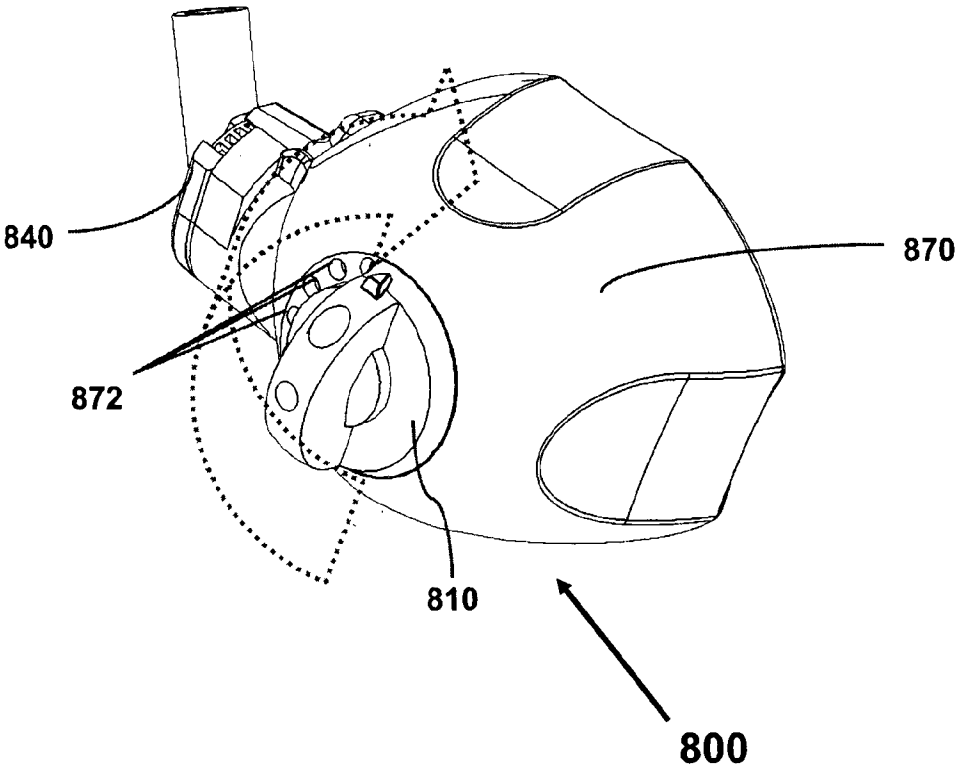
Figure 10:
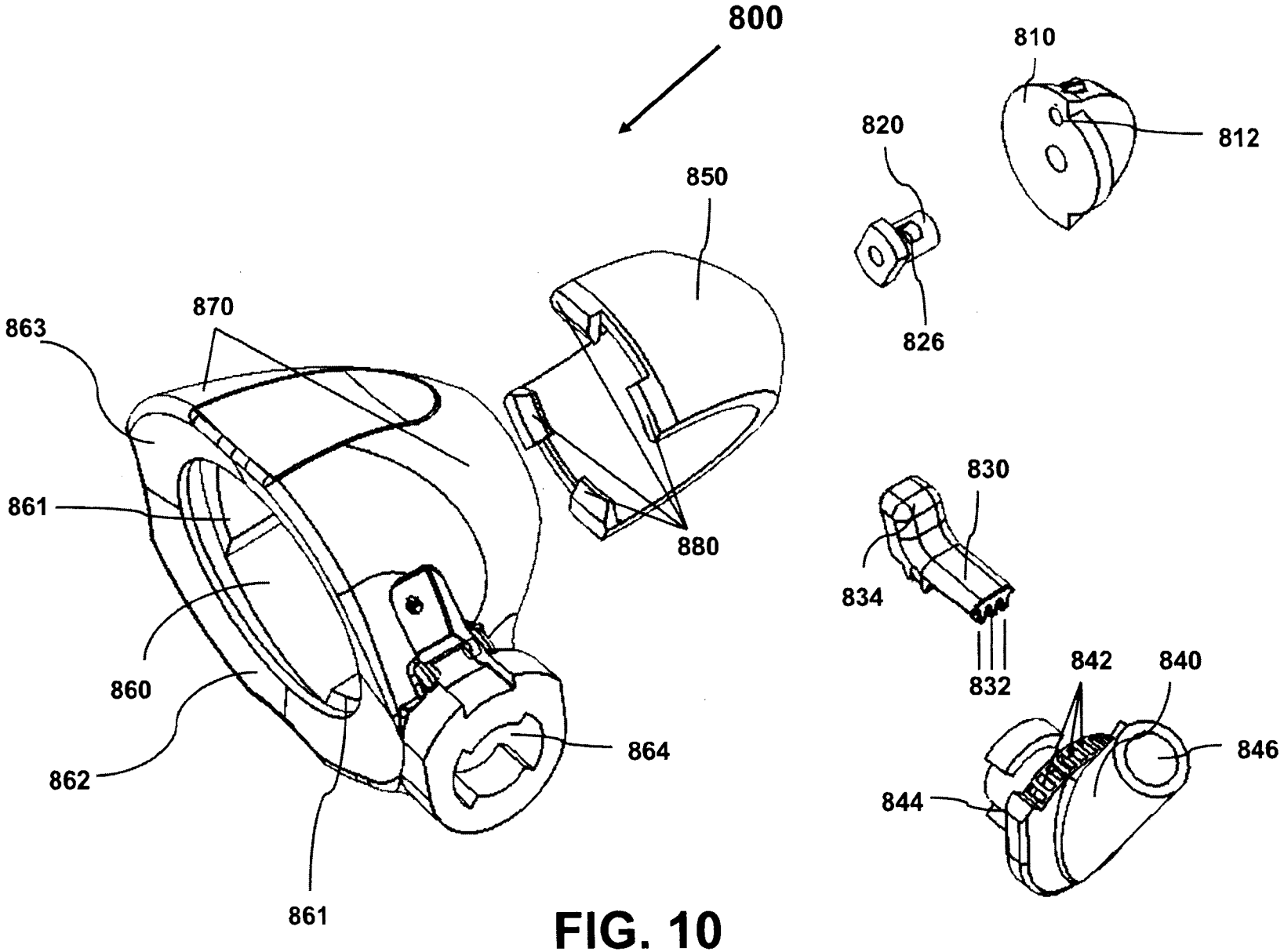
Figure 11:
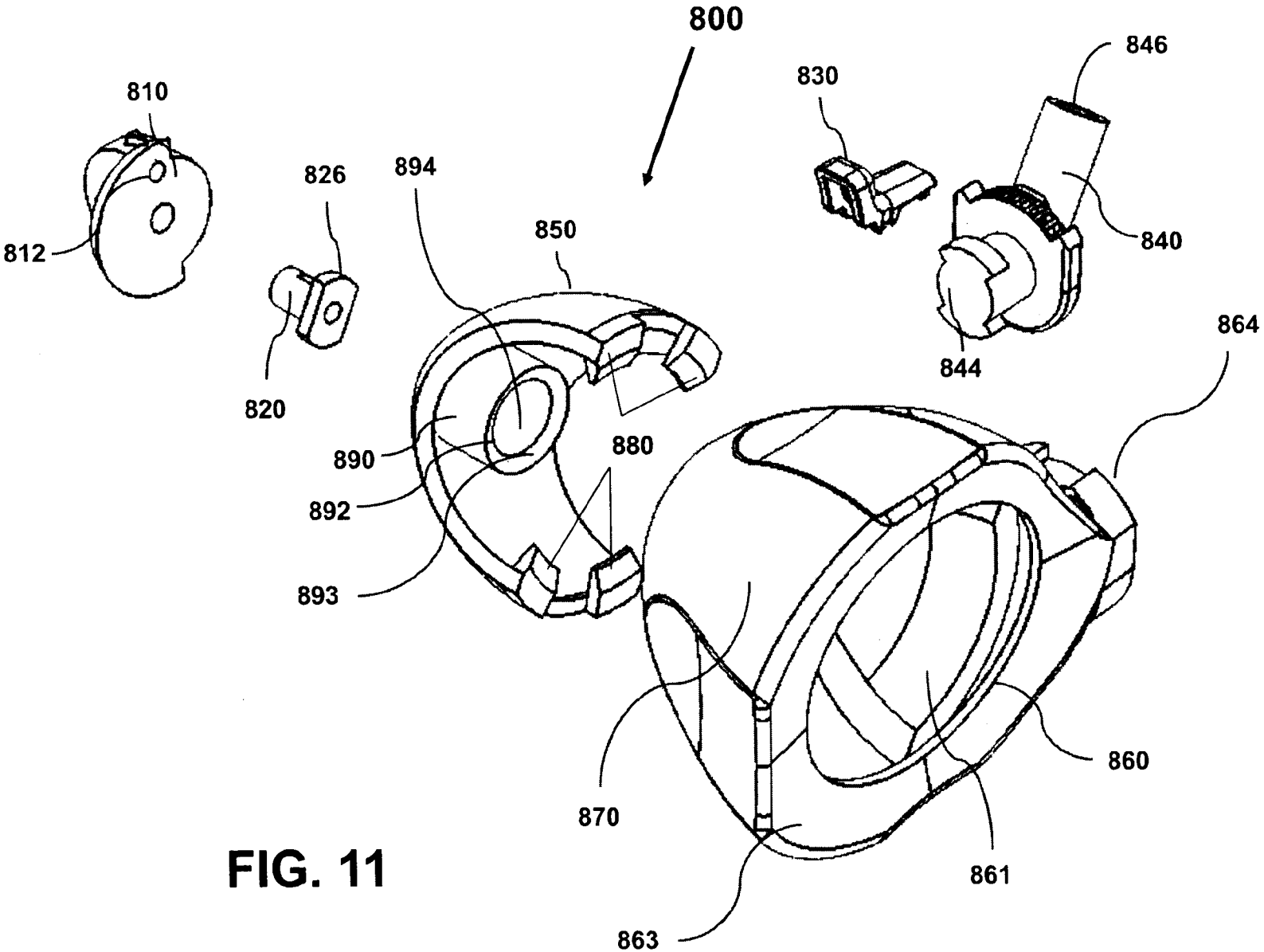

FIG. 17 shows an alternative mechanism for adjusting and fixing the holding pressure on a projectile. A coin, disk or a pin turner 969 can be used to operate multiple pairs of threaded pins 1020 that fit through a respective threaded hole 1040. (For sake of detail, holder 1000 is shown outside club head 1030, but in actual use holder 1000 is inside club head 1030, similar to FIG. 8.) When respective threaded pins 1020 are screwed further into respective holes 1040, threaded pins 1020 exert greater pressure on holder 1000, thereby increasing the pressure with which holding elements 1010 secure projectile 270 with the assembly 800. Although showing four threaded pins 1020, an alternate system may use only a pair of threaded pins 1020 top and bottom, instead of the two pairs of threaded pins 1020 shown, top and bottom.

We claim:

1. A golf club assembly comprising:

a club head having a recess portion;

a projectile holder with at least two opposing holding elements, said projectile holder residing at least partially inside said recess portion;

a hosel attached to said club head, wherein said hosel includes a proximate hosel end and a distal hosel end; and wherein a first imaginary line connecting the center of said proximate hosel end to the center of said distal hosel end and a second imaginary line connecting a first opposing holding element of said at least two opposing holding elements to a second opposing holding element of said at least two opposing holding elements are substantially parallel to one another.

2. The assembly of claim 1, wherein said at least two opposing holding elements is four opposing holding elements, and wherein a third imaginary line connecting a third opposing holding element to a fourth opposing holding element is substantially parallel with said first imaginary line and said second imaginary line.

3. The assembly of claim 1, wherein said at least two holding elements have a first distance setting from one another; wherein a first mechanism attached to said projectile holder is operable to fix said first distance setting or to fix at least a second distance setting of said at least two holding elements from one another; and wherein said first distance setting is different from said second distance setting.

4. The assembly of claim 1, wherein each of said at least two holding elements each further comprises a contact area, wherein said contact area of each of the said at least two holding elements is wider than two golf ball dimples.

5. A golf club assembly comprising:

a club head having a recess portion;

a projectile holder with at least two opposing holding elements, said projectile holder residing at least partially inside said recess portion; and a hosel attaching said club head to a shaft, said shaft having a gripping portion with a proximate end and a distal end, wherein a first imaginary line connecting the center of said proximate gripping end to the center of said distal gripping end and a second imaginary line connecting a first opposing holding element of said at least two opposing holding elements to a second opposing holding element of said at least two opposing holding elements are substantially parallel to one another.

6. The assembly of claim 5, said shaft having a proximate end and a distal end, wherein a third imaginary line connecting said the center of said shaft proximate end to said shaft distal end is substantially parallel to said second imaginary line.

* * * * *

UNITED STATES PATENT AND TRADEMARK OFFICE

CERTIFICATE OF CORRECTION

PATENT NO. : 8,246,480 B2
APPLICATION NO. : 12/847210
DATED : August 21, 2012
INVENTOR(S) : William Parks et al.

It is certified that error appears in the above-identified patent and that said Letters Patent is hereby corrected as shown below:

In the Drawings

Delete drawings, sheets 11 through 17, which consist of FIGS. 8, 9A, 9B, 10, 11, 12A, 12B, 13A, 13B, 13C, 14A, and 14B, should be replaced with the seven attached sheets.

Signed and Sealed this
Twenty-seventh Day of May, 2014

Michelle K. Lee

Michelle K. Lee
*Deputy Director of the United States Patent and Trademark Office*